US006690277B1

(12) United States Patent
Hansen et al.

(10) Patent No.: US 6,690,277 B1
(45) Date of Patent: Feb. 10, 2004

(54) SECURITY SYSTEM

(76) Inventors: Henry Louis Hansen, 3626 W. Ox Rd., Fairfax, VA (US) 22033; Albert D. Seim, II, 9406 Sir Barry Dr., Richmond, VA (US) 23229

( * ) Notice: Subject to any disclaimer, the term of this patent is extended or adjusted under 35 U.S.C. 154(b) by 1 day.

(21) Appl. No.: 09/815,638

(22) Filed: Mar. 23, 2001

Related U.S. Application Data

(60) Provisional application No. 60/192,102, filed on Mar. 24, 2000.

(51) Int. Cl.[7] ..... G08B 13/14

(52) U.S. Cl. ..... 340/568.2; 340/568.3

(58) Field of Search ..... 340/571, 572.1, 340/568.1, 568.2, 568.4, 691.5, 568.3, 310.01, 310.06, 310.08, 572.3; 178/2 R, 2 C

(56) References Cited

U.S. PATENT DOCUMENTS

| | | | | |
|---|---|---|---|---|
| 4,139,843 A | * | 2/1979 | Watanabe | 340/505 |
| 4,155,073 A | * | 5/1979 | Ulch et al. | 340/505 |
| 4,455,464 A | | 6/1984 | Leyden | 200/61.93 |
| 4,573,041 A | | 2/1986 | Kitagawa et al. | 340/538 |
| 4,616,113 A | | 10/1986 | Jank et al. | 200/61.13 |
| 4,620,182 A | | 10/1986 | Keifer | 340/568.2 |
| 4,623,765 A | | 11/1986 | Leyden | 200/43.22 |
| 4,663,499 A | * | 5/1987 | Duval | 179/2 R |
| 4,736,826 A | | 4/1988 | White et al. | 191/12.2 A |
| 4,746,909 A | | 5/1988 | Isreal et al. | 340/568.1 |
| 4,772,878 A | | 9/1988 | Kane | 340/568.4 |
| 4,896,140 A | | 1/1990 | Biever et al. | 340/568.2 |
| 4,899,217 A | * | 2/1990 | MacFayden et al. | 358/86 |
| 5,072,213 A | | 12/1991 | Close | 340/568.2 |
| 5,089,807 A | | 2/1992 | Shim | 340/568.2 |
| 5,094,396 A | | 3/1992 | Burke | 242/378.2 |
| 5,103,984 A | | 4/1992 | Leyden et al. | 211/7 |
| 5,124,685 A | | 6/1992 | Rankin | 340/568.2 |
| 5,146,205 A | | 9/1992 | Keifer et al. | 340/568.2 |
| 5,154,072 A | | 10/1992 | Leyden | 70/18 |
| 5,160,048 A | | 11/1992 | Leyden et al. | 211/7 |
| 5,172,098 A | | 12/1992 | Leyden et al. | 340/568.2 |
| D335,439 S | | 5/1993 | Leyden et al. | D8/332 |
| 5,246,183 A | | 9/1993 | Leyden | 242/375 |
| 5,270,681 A | | 12/1993 | Jack | 340/427 |
| 5,279,135 A | | 1/1994 | Leyden et al. | 70/18 |
| 5,289,559 A | | 2/1994 | Wilson | 340/568.2 |
| D345,092 S | | 3/1994 | Leyden et al. | D8/332 |
| 5,341,124 A | | 8/1994 | Leyden et al. | 340/568.4 |
| 5,345,219 A | | 9/1994 | Rogers | 340/568.2 |
| 5,345,220 A | | 9/1994 | Wachsman | 340/568.4 |
| 5,421,667 A | | 6/1995 | Leyden et al. | 403/300 |
| 5,467,075 A | | 11/1995 | Rand | 340/568.4 |
| 5,543,782 A | | 8/1996 | Rothbaum et al. | 340/568.2 |
| 5,552,771 A | | 9/1996 | Leyden et al. | 340/568.2 |

(List continued on next page.)

FOREIGN PATENT DOCUMENTS

JP 9054882 A 2/1997

OTHER PUBLICATIONS

Action Digital Interactive Camcorder/Camera Display System Brochure, 1998.

*Primary Examiner*—Van Trieu
(74) *Attorney, Agent, or Firm*—John H. Thomas, P.C.

(57) ABSTRACT

A security system for monitoring a product includes a sensor coupled to the product that is further coupled to a splitter box. The splitter box includes a first shift register for storing data that indicates whether the product is coupled to the sensor. A main controller unit coupled to the splitter box causes the splitter box to transmit the data and then causes the data to be stored in a table. After storing the data, the data is transmitted to a second shift register disposed in the splitter box. A logic circuit disposed in the splitter box compares the data stored in the second shift register to a signal indicating whether the product is still coupled to the sensor and generates an alarm signal if the product is no longer coupled to the sensor. The alarm signal is subsequently transmitted to the main controller unit which responds to the signal by sounding a horn.

8 Claims, 17 Drawing Sheets

U.S. PATENT DOCUMENTS

| | | | | |
|---|---|---|---|---|
| 5,561,417 | A | 10/1996 | Rothbaum et al. | 340/568.2 |
| 5,565,848 | A | 10/1996 | Leyden et al. | 340/568.2 |
| 5,577,855 | A | 11/1996 | Leyden et al. | 403/291 |
| 5,604,484 | A | 2/1997 | Rogers | 340/568.8 |
| 5,617,073 | A | 4/1997 | Wilson | 340/568.2 |
| 5,652,569 | A | 7/1997 | Gerstenberger et al. | 340/573.4 |
| 5,676,258 | A | 10/1997 | Leyden et al. | 211/7 |
| 5,699,591 | A | 12/1997 | Kane | 24/304 |
| 5,726,627 | A | 3/1998 | Kane et al. | 340/531 |
| 5,796,337 | A | 8/1998 | Wachsman | 340/568.8 |
| 5,821,857 | A | 10/1998 | Rand | 340/568.8 |
| 5,823,358 | A | 10/1998 | Leyden et al. | 211/8 |
| 5,861,807 | A | 1/1999 | Leyden et al. | 340/568.2 |
| 5,936,525 | A | 8/1999 | Leyden et al. | 340/568.2 |
| 6,027,277 | A | 2/2000 | Leyden et al. | 340/568.2 |
| 6,039,498 | A | 3/2000 | Leyden et al. | 340/568.2 |
| 6,087,939 | A | 7/2000 | Leyden et al. | 340/568.2 |
| 6,104,289 | A | 8/2000 | Rand | 340/568.4 |
| 6,147,603 | A | 11/2000 | Rand | 340/568.2 |
| 6,215,400 | B1 | 4/2001 | Rand et al. | 340/568.2 |

* cited by examiner

+9V
152
R5
200
196
F1
RGE300
202
R26
75K
191
J3
144
178
28
186
204
50
28
RJ45 RT ANGAGER
+3.3V
100
218
R4
75K
R27
75K
220
216
J1
210
EXTERKA1 APT FN1ICM
214
PHONE JACK STEREO
168
J4
EXTERKA1 MIMS
32
3X.166 MDR
170
172
+9V
166
Q1
R19
1K
164
BCPS9CT
162
B21
30
BU22ER

SECURITY SYSTEM

This application claims benefit of provisional application No. 60/192,102, filed Mar. 24, 2000.

FIELD OF THE INVENTION

This application relates to security systems and anti-theft devices. More particularly, the application relates to anti-theft security systems for in-store consumer product displays.

BACKGROUND OF THE INVENTION

U.S. Pat. No. 5,172,098 to Leyden et al, U.S. Pat No. 5,552,771 to Leyden et al, U.S. Pat. No. 5,543,782 to Rothbaum et al, U.S. Pat. No. 5,726,627 to Kane et al, and U.S. Pat. No. 5,821,857 to Rand show the current state of the art of security systems and are each hereby incorporated by reference. U.S. Pat. No. 5,094,396 to Burke, hereby incorporated by reference, discloses a retractable cord reel assembly for telephone extension cords, and is applicable to security systems.

SUMMARY OF THE INVENTION

In accordance with a first aspect of the present invention, a security system includes a control module that is adapted to generate an alarm event based on an alarm signal and a splitter box coupled to the control module. The splitter box has at least one data storage location and is further adapted to generate the alarm signal. The security system additionally includes a sensor circuit coupled between a product sensor and the splitter box. When the sensor is attached to a product, the sensor circuit is close (in a first state). The security system stores a data bit in the storage location to signify that a product is being monitored. A circuit in the data storage unit compares the data bit with the sensor circuit. If the sensor circuit is opened (a second state), the circuit generates the alarm signal.

According to another aspect of the present invention, a security system for monitoring a product that requires power to be operational includes an alarm generating unit that coupled to the product and that is further coupled to a power supply. A power adaptor coupled to the alarm generating unit and to the product supplies power from the alarm generating unit the product.

According to yet another aspect of the present invention, a method of providing security for at least one product includes the step of a) providing an alarm system with a control module and one or more splitter boxes, each having a data storage location for storing at least one data bit; b) attaching at least one sensor to the product; c) connecting the sensor to the splitter box; d) detecting a first state of said sensor circuit at an initial time; e) storing said state of the sensor circuit as the data bit in the data storage location; f) detecting the state of the sensor circuit at a subsequent time; h) comparing the data bit to the state of the sensor at the subsequent time; and i) generating an alarm signal in the event that the sensor circuit has changed states.

DETAILED DESCRIPTION

Figure 1:
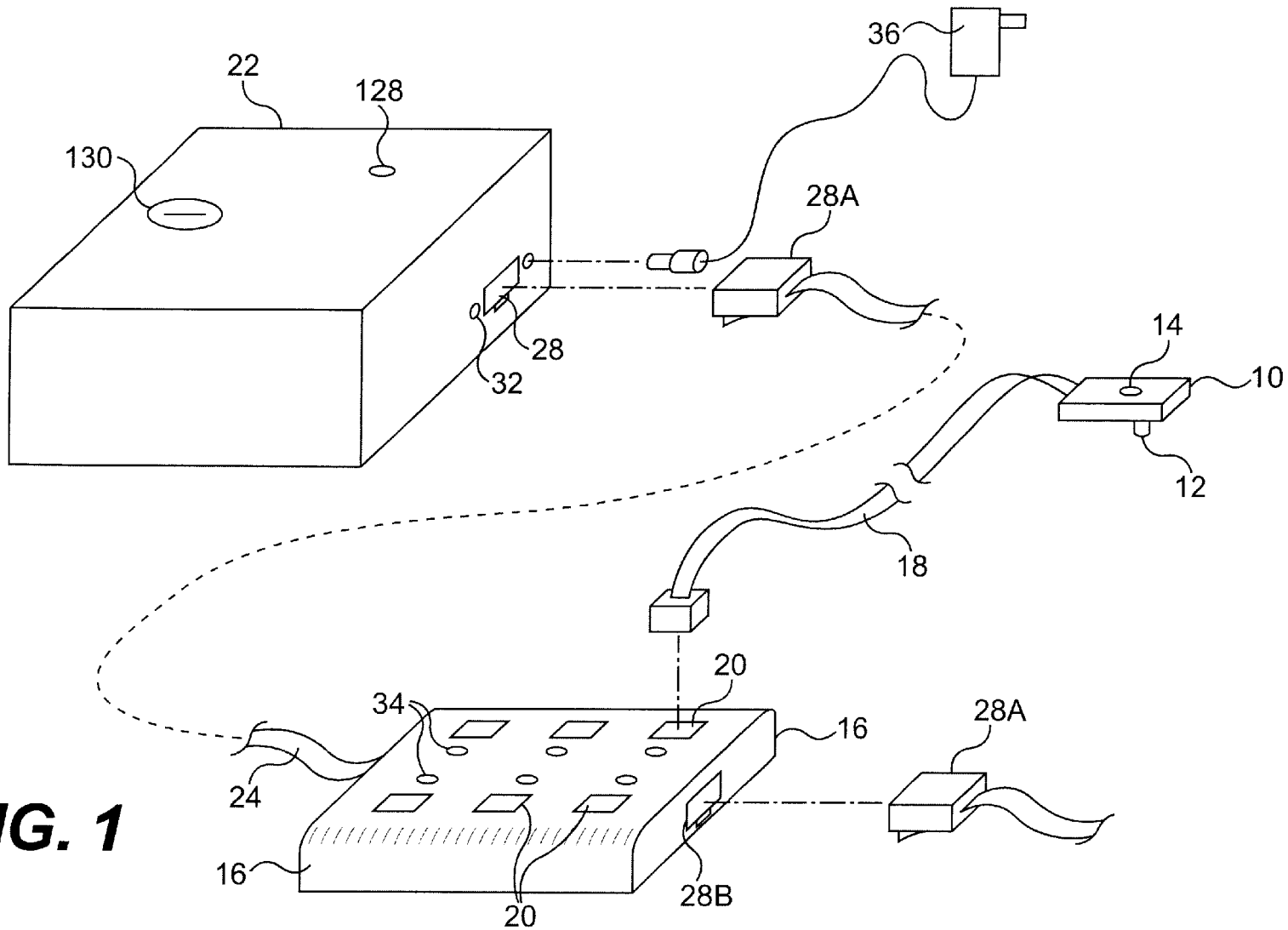
FIG. 1 is a perspective view of the main system components of the security system of the invention.
Figure 2:
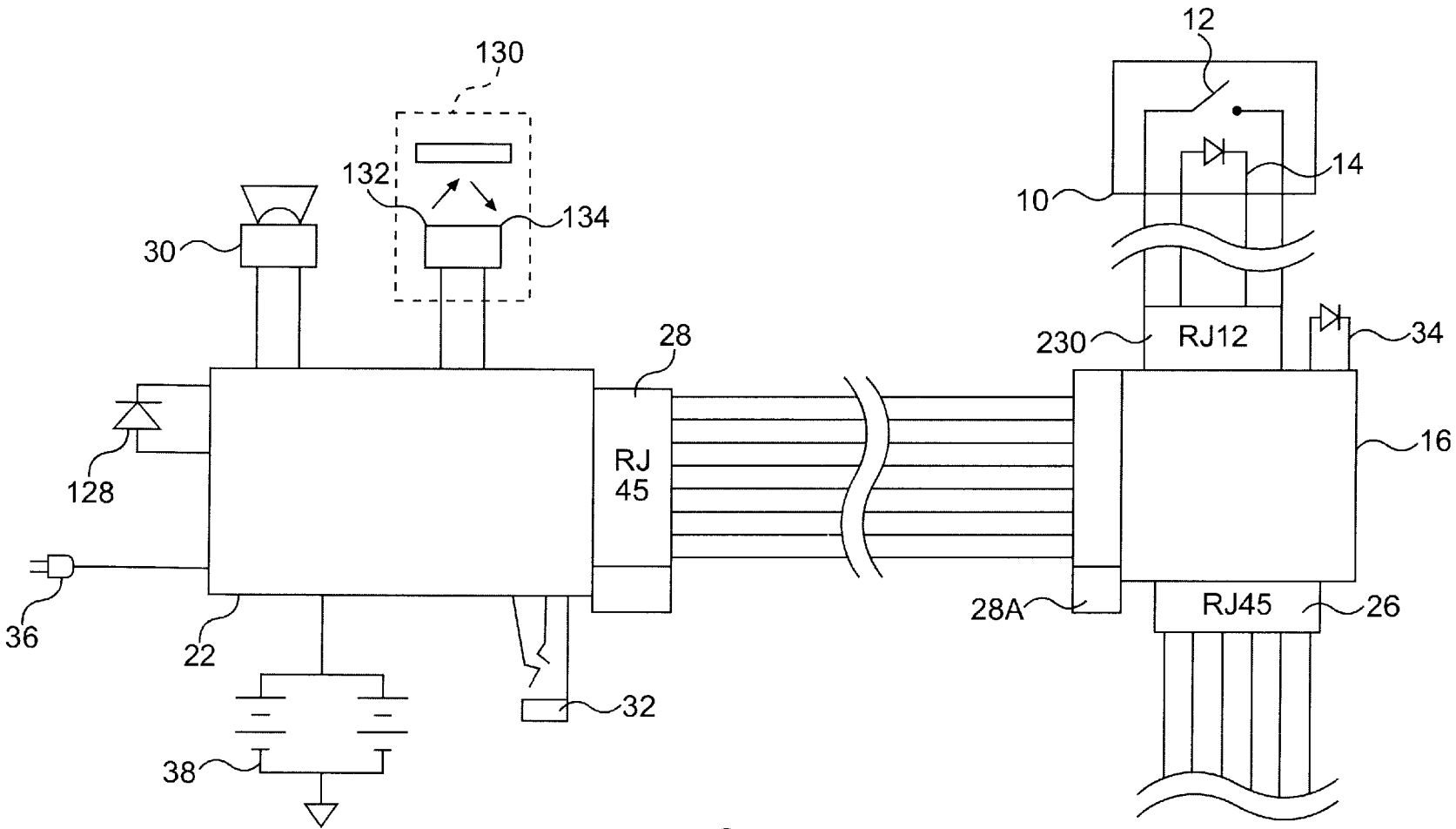
FIG. 2 is a block diagram of the security system.
Figure 3A:
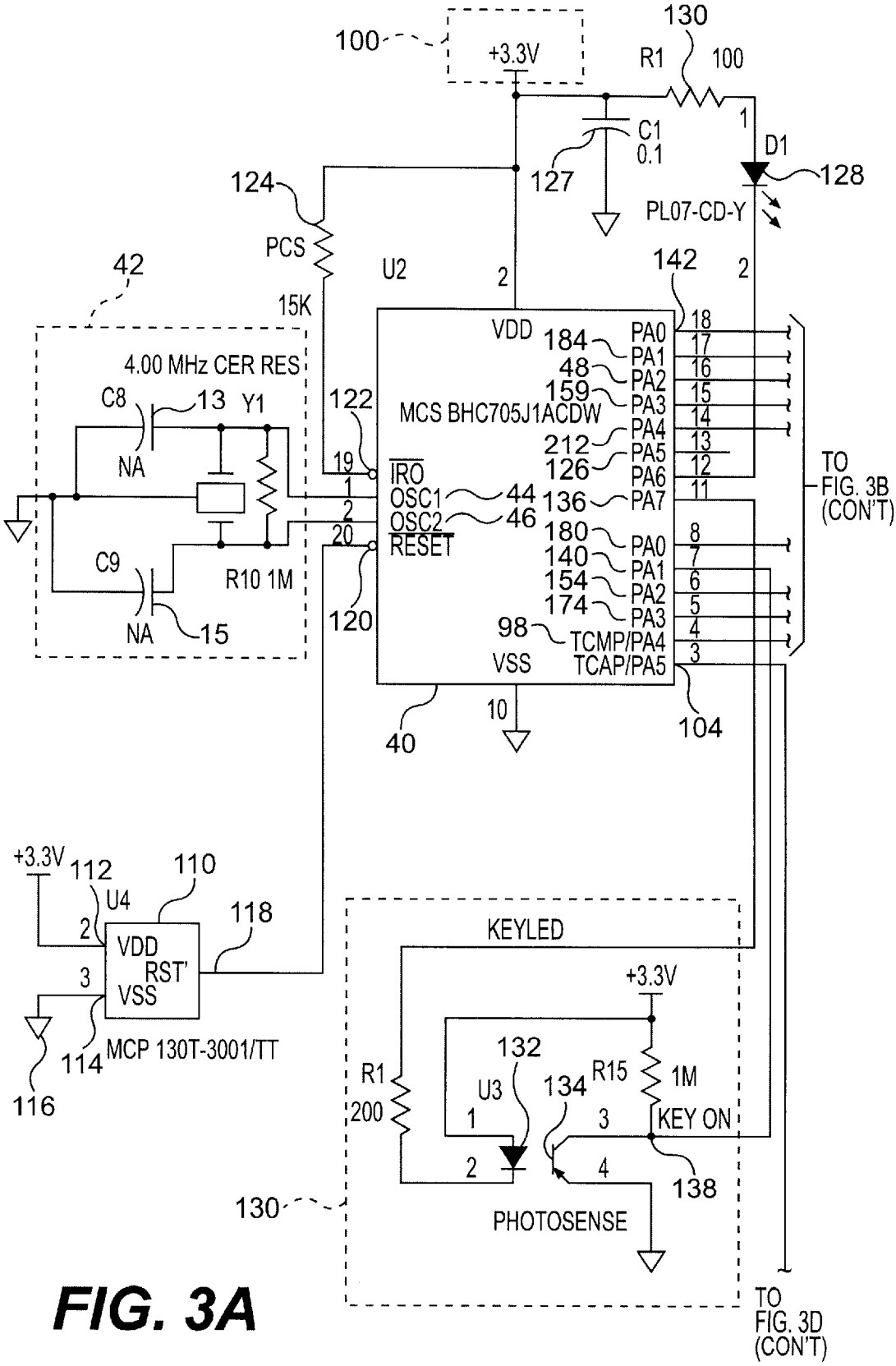
FIGS. 3A–D are electrical schematics of a main controller unit.
Figure 3B:
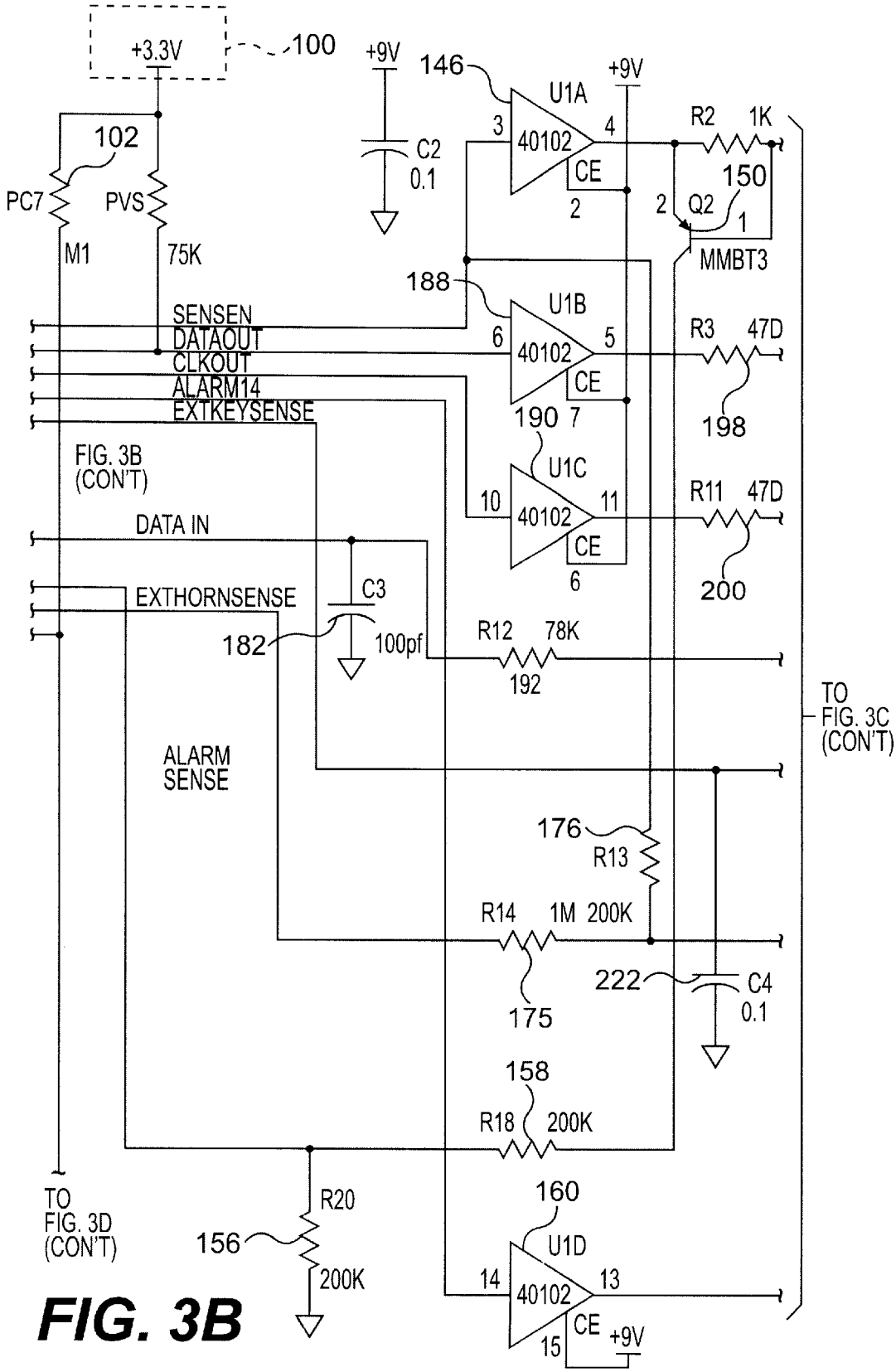
Figure 3C:
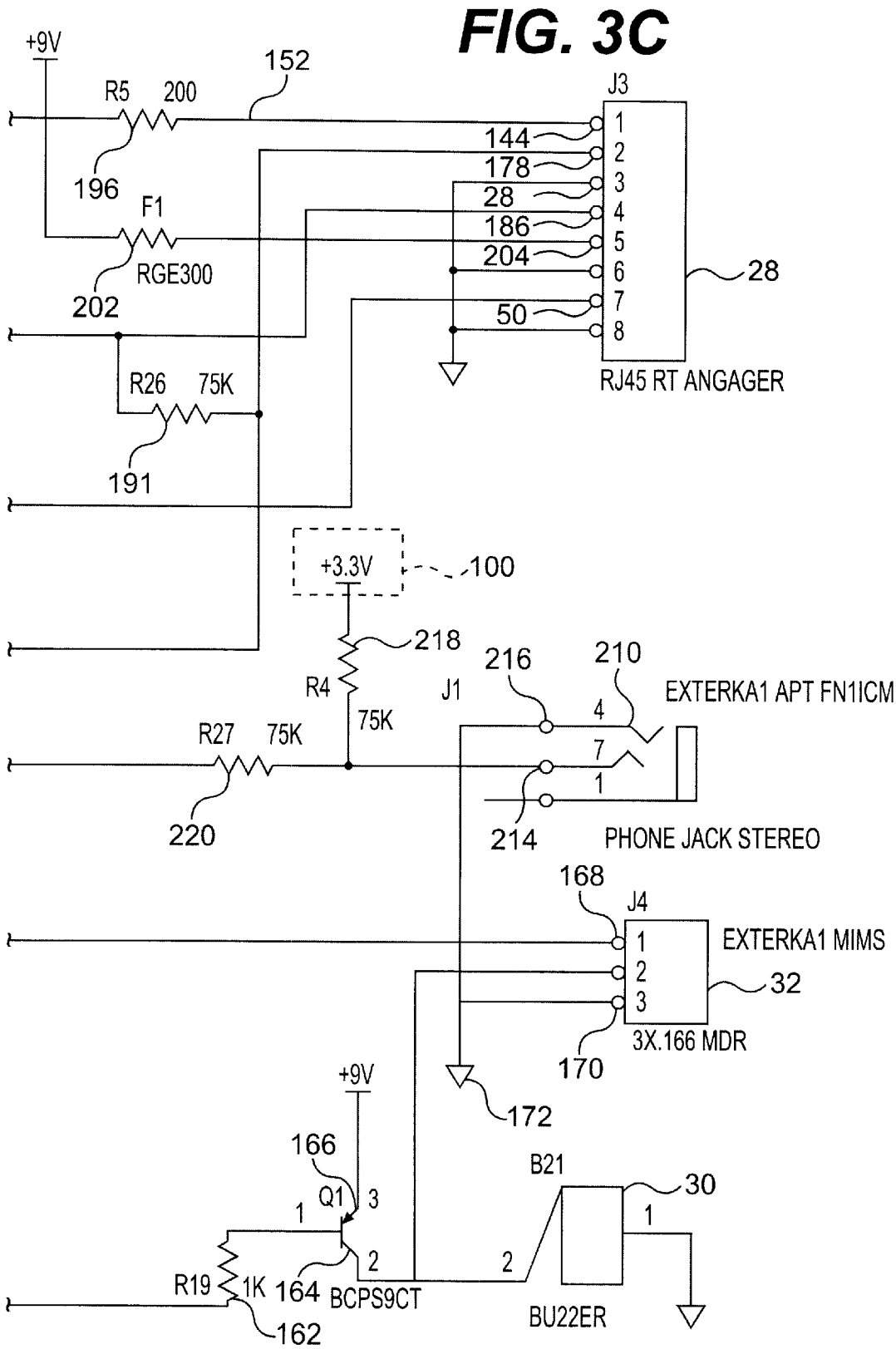
Figure 3D:
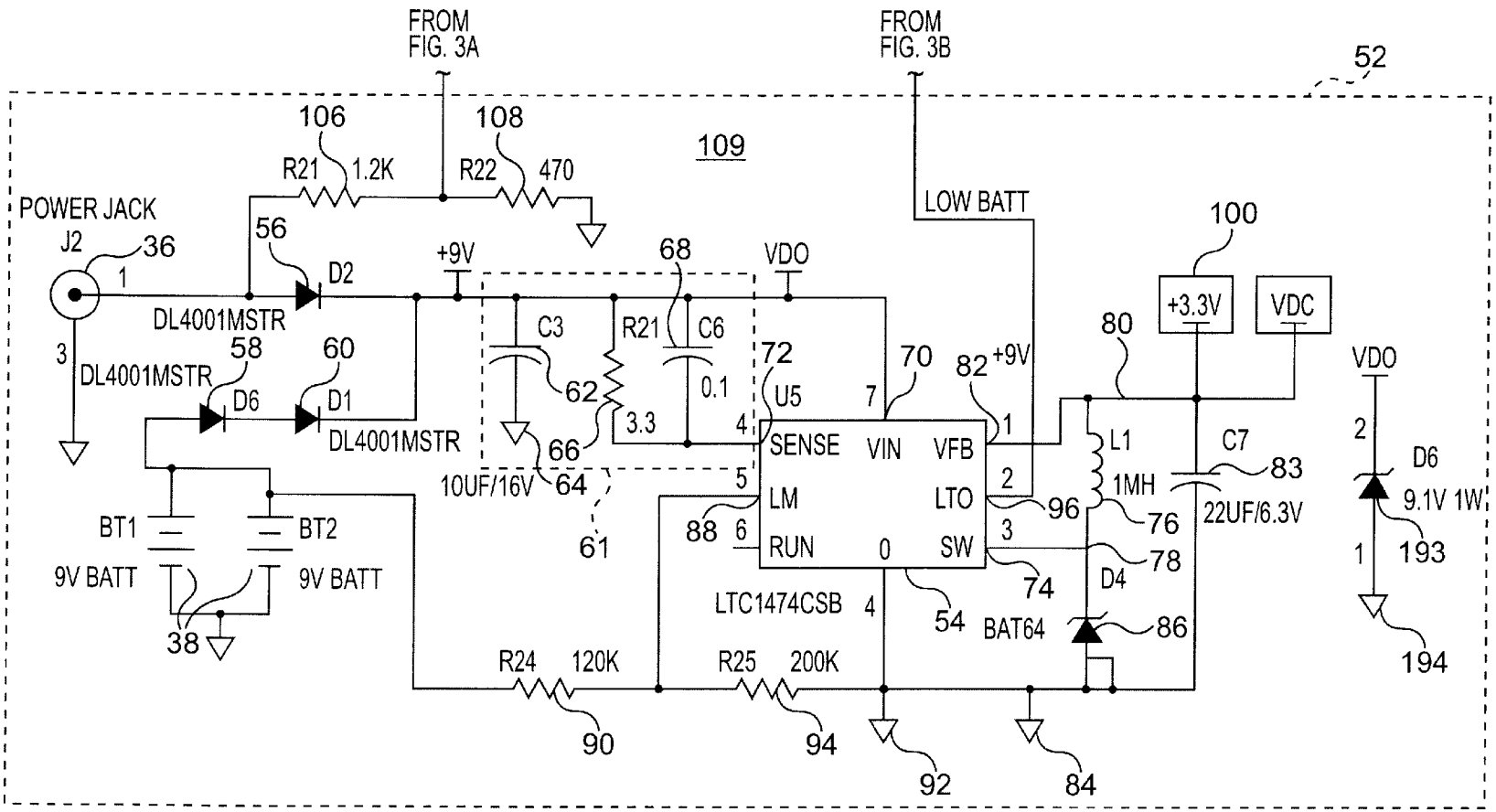
Figure 4A:
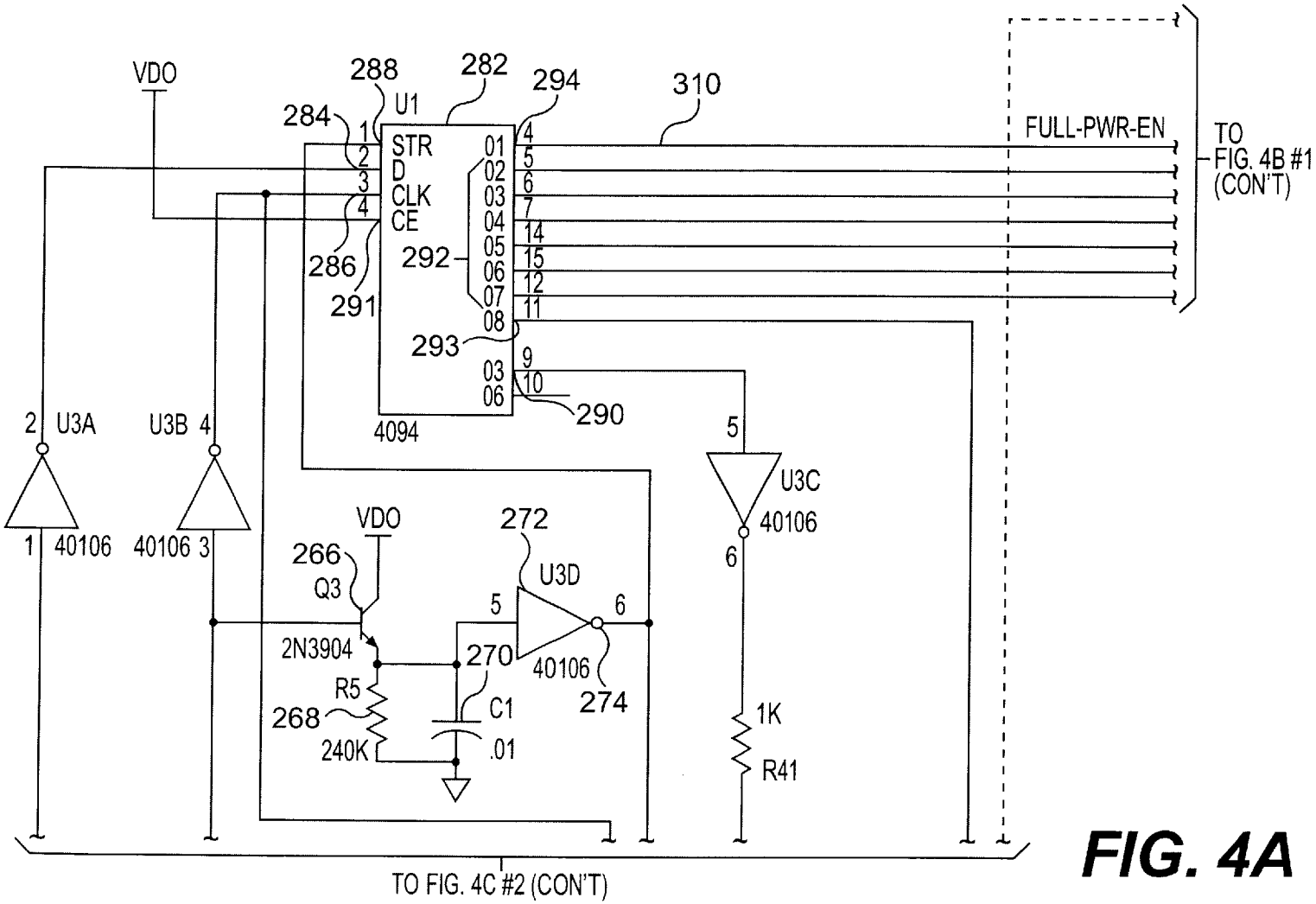
FIGS. 4A–D are electrical schematics of a splitter box.
Figure 4B:
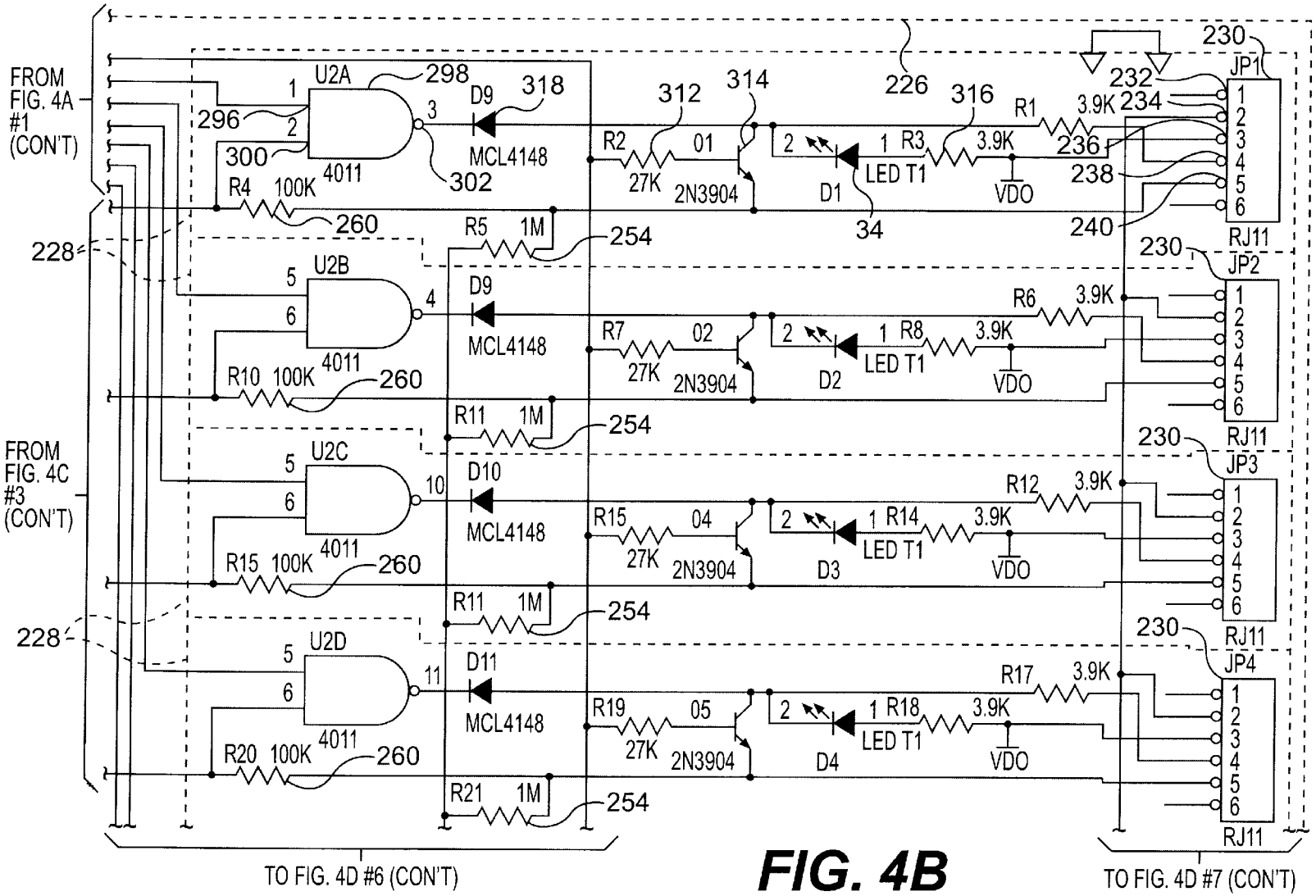
Figure 4C:
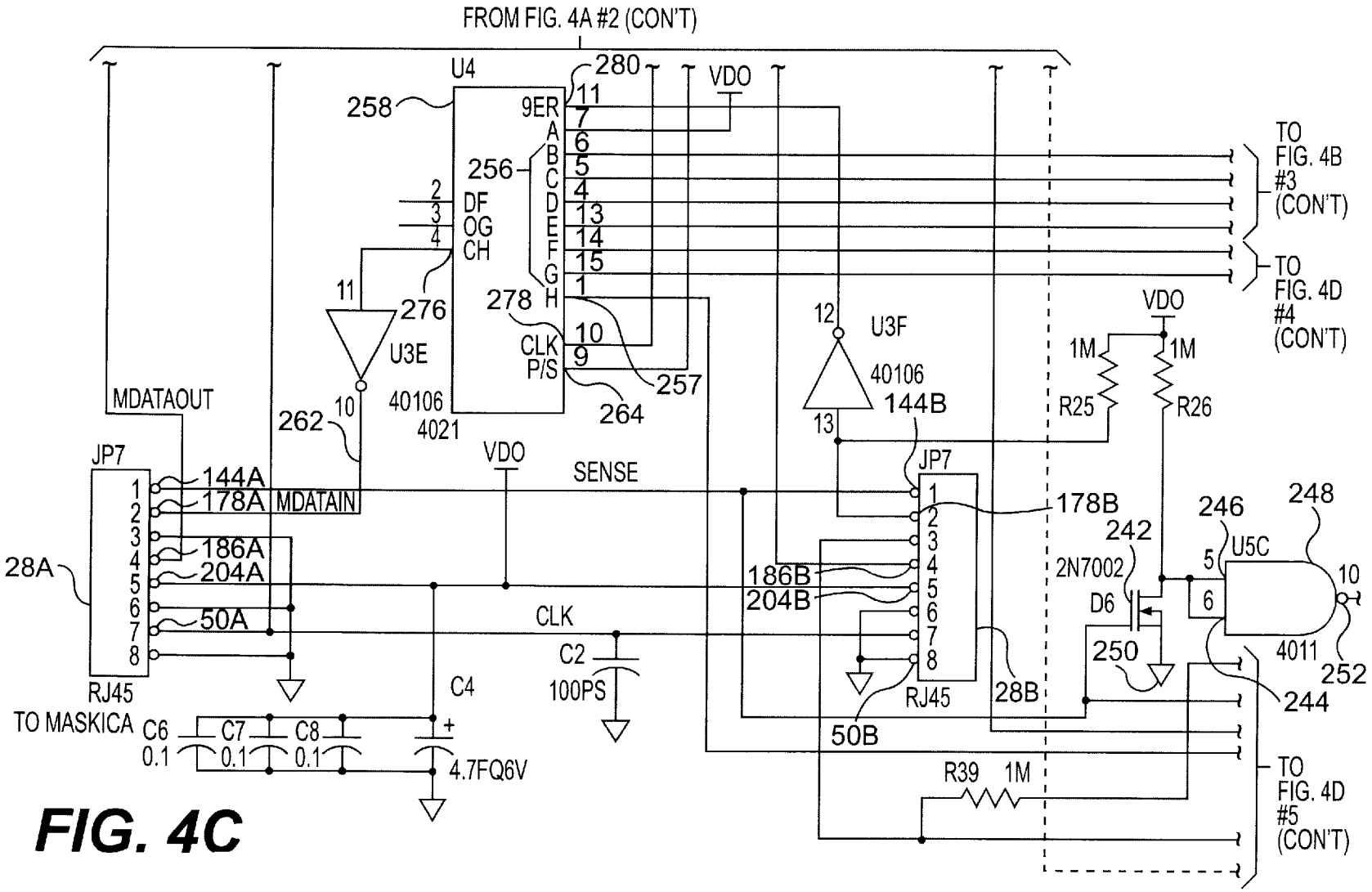
Figure 4D:
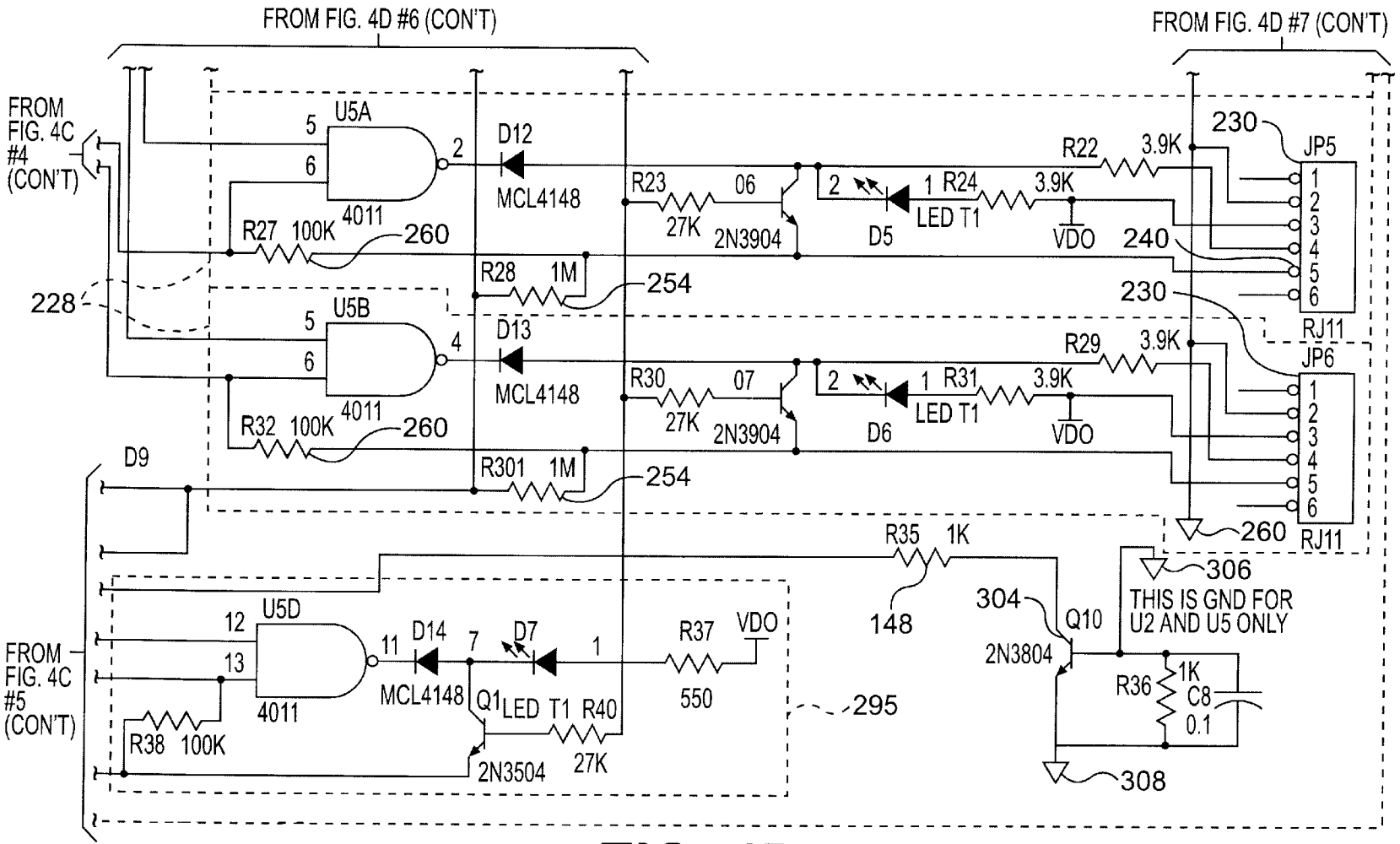

Referring to FIGS. 1 and 2, a security system 9 for monitoring a plurality of articles (not shown) includes a plurality of product sensors 10 (one is shown), each coupled to a corresponding one of the articles. Each product sensor 10 includes a detector switch 12, such as a plunger switch, that occupies a first state, e.g., depressed, when the product sensor 10 is coupled to the corresponding article and that occupies a second state, e.g., not depressed, when the product sensor 10 is not coupled to the corresponding article. An LED 14 disposed in each product sensor 10 may be activated or illuminated according to the state of the detector switch 12, such that, when the detector switch 12 is in the first state, the LED 14 is activated and when the detector switch 12 is in the second state, the LED 14 is de-activated. In addition to being coupled to the corresponding article, each product sensor 10 is further coupled to one of a plurality of splitter boxes 16 (one is shown). More particularly, each product sensor 10 further includes a cable 18, preferably routed through a retractable cord reel of the type described in U.S. Pat. No. 5,094,396 or alternatively routed through a standard curly cord type used with telephones, for attachment to one of a plurality of ports 20, such as RJ-11 jacks, disposed in one of the splitter boxes 16. The splitter boxes 16 are, in turn, coupled to each other and to a main controller unit 22 in a daisy-chain arrangement. Specifically, the splitter boxes 16 each include a captive eight-conductor cable 24 and an eight-conductor port 27, such as an RJ-45 jack, for attaching the splitter boxes 16 to an eight-conductor port 28 disposed in the main controller unit 22 and for attaching the splitter boxes 16 to each other. Generally, if one of the product sensors 10 becomes disengaged from the article that the product sensor 10 is monitoring, the detector switch 12 changes states causing the splitter box 16 to transmit an alarm signal to the main controller unit 22. The main controller unit 22 responds to the alarm signal by generating an audible alarm to alert security personnel. For example, the main controller unit 22 may generate the audible alarm by sounding an internal horn 30, such as a piezo electric buzzer, disposed in the main controller unit 22 and/or by sounding an external horn (not shown) coupled to the main controller unit 22 via a jack 32.

To allow security personnel to identify the product sensor 10 that has become disengaged from the article, the security system 9 may also cause an LED 34 disposed in the splitter box 16 to which the disengaged product sensor 10 is coupled to turn on and off, or flash, in an intermittent manner. To enable this feature, the splitter boxes 16 include a plurality of LEDs 34, each of which is disposed adjacent to, and which corresponds to, a different one of the ports 20. Thus, each LED 34 indicates the engaged or disengaged status of the product sensor 10 that is coupled to the corresponding, adjacent port 20. As will be appreciated by one having ordinary skill in the art, although the splitter box 16 illustrated in FIG. 1 includes six ports 20, the splitter box 16 may instead include any number of ports 20 for supporting any number of product sensors 10. As will further be appreciated by one having ordinary skill in the art, any of the product sensors 10 may include a two-color LED instead of a single color LED 14, each color representing one of either the engaged or disengaged state of the product sensor 10. Further, the detector switch 12 disposed in the product sensor 10 may be implemented using any conventional switch that can be configured to change state depending on whether the product sensor 10 is coupled or not coupled to an article.

The security system 9 is further configured to distribute power from the main controller unit 22 to each of the splitter boxes 16 and the product sensors 10 so that individual power supplies are not required for each component of the security system 9. More particularly, the main controller unit 22 normally receives power from an external power source (not shown) via a conventional plug-in wall-mounted transformer 36 and the power is thereafter routed from the main controller unit 22 to each of the splitter boxes 16 via the cables 24 and from the splitter boxes 16 to the product sensors 10 via the cables 18. As a result, the locations at which the splitter boxes 16 are disposed need not be limited to locations near individual power supplies but may instead be positioned at any convenient location. Further, to ensure continued operation of the security system 9 in the event of a power failure, the main control unit 22 includes a set of batteries 38 so that the security system 9 is continuously receiving power from either the wall-mounted transformer 36 or the batteries 38. In addition, to alert security personnel before a potential power failure due to dead batteries, the horn 30 disposed in the main controller unit 22 may further be configured to sound when a low battery condition exists.

Referring also to FIGS. 3A–D, the main controller unit 22 may include a programmable microcontroller 40 which may be implemented using, for example, an MC68HC705J1ACDW chip which may include an oscillator (not shown) from which a clock signal may be derived. A ceramic resonator 42 coupled to the microcontroller 40 via a set of input pins 44 and 46 disposed on the microcontroller 40 may be used to drive the oscillator and the microcontroller 40 may be configured to supply the resulting clock signal to the splitter boxes 16 via an output pin 48 that is coupled to a pin 50 of the RJ-45 jack 28. As described above, the RJ-45 jack 28 and the cable 24 are used to couple the splitter boxes 16 to the main controller unit 22 and to each other via a daisy chain arrangement. Thus, the clock signal ensures that the components of the security system 9, i.e., the splitter boxes 16 and the main controller unit 22, are operating in a synchronous manner with respect to each other As will be understood by one hang ordinary skill in the art, a set of capacitors 13 and 15 shown m the ceramic resonator circuit 42 may be disposed in the ceramic resonator circuit in which case the capacitors need not be added to the main controller unit 22.

The main controller unit 22 may further include a power supply circuit 52 that receives a nine volt signal from the wall-mounted transformer 36 or from the batteries 38 and converts the nine volt signal to a +3.3 volt signal using a switching power supply controller 54 such as a switching power supply no. LTC1474CS5 manufactured by Linear Technology. Specifically, nine volts are supplied via either the wall mounted transformer 36 or the batteries 38 to a steering diode 56 (if received from the wall-mounted transformer 36) or to a set of steering diodes 58 and 60 (if received from the batteries 38). As will be understood by one having ordinary skill in the art, the two steering diodes 58, 60 are disposed between the batteries 38 and switching power supply controller 54 and a single diode 56 is disposed between the wall-mounted transformer 36 and the switching power supply controller 54 so that the wall-mounted transformer 36 is treated as the preferential power source from which power will be drawn by the switching power supply controller 54, if available, so that battery power is conserved. After flowing through the steering diodes 56 or 58 and 60, the power is supplied to a filtering circuit 61 including a capacitor 62 coupled between the output of the steering diodes 56, 60 and a grounded terminal 64 and a resistor 66 and capacitor 68 coupled in parallel. The filtering circuit 61 removes any noise spikes from the voltage signal before it is supplied to a set of first and second input pins 70, 72 disposed on the switching power supply controller 54. The switching power supply controller 54 receives the nine volt signal via the first input pin 70 and then supplies a fluctuating output voltage signal that switches between zero and nine volts at a first output pin 74 also disposed on the switching power supply controller 54. The switching power supply controller 54 is designed to switch the voltage output signal between zero and nine volts by allowing current to flow to the output pin 74 for a time sufficient to allow an inductor 76 to charge up to a predetermined voltage value and such that the voltage output at output pin 74 is at zero volts for a period of time sufficient to allow the inductor 76 to discharge the voltage at a terminal 78. The switching action of the switching power supply controller 54 and the charging and discharging effects of the inductor 76 causes the output voltage supplied to a terminal 80 to remain at a constant +3.3 volts, provided that the switching time employed by the switching power supply controller 54 is appropriate. An input pin 82 disposed on the switching power supply controller 54 that is coupled to the terminal 80 senses the voltage at the terminal 80 and causes the switching time of the switching power supply controller 54 to adjust if the voltage is either below or above a predetermined value, e.g., +3.3 volts. To further filter the current, a capacitor 82 is coupled between the terminal 80 and to a grounded terminal 84 to remove voltage spikes occurring at the terminal 80. Further, a diode 86 coupled between the output pin 74 of the switching power supply controller 54 and the grounded terminal 84 prevents current flow therethrough when the output voltage supplied by the output pin 74 to the terminal 78 is at or above nine volts and allows current flow therethrough when the output voltage at the terminal 78 is below nine volts, i.e., when the switching power supply controller 54 is turned off, so that the inductor 76 may discharge to the grounded terminal 84. The second input pin 72 disposed on the switching power supply controller 54 is used to limit the level of current being supplied by the switching power supply controller 54. During start-up, the current required to charge a set of capacitors disposed in the main controller unit 22 and described further herein, may cause an over-current condition or over-voltage condition to occur at the switching power supply controller 54. To prevent such a condition from occurring the resistor 66 may be sized to limit the current permitted to flow through the switching power supply controller 54. More particularly, the second input pin 72 disposed on the switching power supply controller 54 senses the current supplied thereto and if the current exceeds a predetermined maximum level, as determined in part by the size of the resistor 66, then the switching power supply controller 54 is temporarily turned off until the current supplied to the switching power supply controller 54 no longer exceeds the predetermined voltage level. Thus, the likelihood that either an over-current condition will occur is reduced. A third input pin 88 disposed in the switching power supply controller 54 is coupled to the batteries 38 by a resistor 90 and is further coupled to a grounded terminal 92 by a resistor 94 to allow the switching power supply controller 54 to sense the battery output voltage. If the battery output voltage sensed at the third input pin 88 falls below a predetermined level, then the switching power supply controller 54 notifies the microcontroller 40 of the low battery condition by sending a low battery signal from a second output pin 96 disposed on the switching power supply controller 54 to an input pin 98 disposed on the microcontroller 54. Specifically, if the batteries 38 are low, then the second output pin 96 of the switching power supply controller 54 is connected to a grounded terminal 92 thereby causing a logic level zero to appear at the input pin 98 of the microcontroller 40. If instead the battery power is not low, then the switching power supply controller 54 places a logic level zero on the second output pin 96. With the logic level zero on the second output pin 96, current flows from a voltage source 100, also denoted Vcc, through a resistor 102 which is also coupled to the input 98 on the microcontroller 40 thereby causing a logic level one to be supplied to the input pin 98 on the microcontroller 40. As will be understood by one having ordinary skill in the art, the predetermined voltage level that will be treated as a low battery level may be adjusted by adjusting the size of the resistors 90 and 94. Thus, for example, if the resistor 90 is an 820 Kohm resistor and if the resistor 94 is a 200 Kohm resistor, then the switching power supply controller 54 senses a low battery condition when the voltage supplied to the third input pin 88 is as low as 7 volts. In addition to being supplied to the steering diode 56, the power supplied by the wall-mounted transformer 36 is also supplied to the microcontroller 40 via an input pin 104 so that the microcontroller 40 may use the signal to sense whether the wall-mounted transformer 36 is supplying power. If the wall-mounted transformer 36 is supplying power to the microcontroller 40, the LEDs 34 disposed in the splitter boxes 16 and the LEDs 14 disposed in the product sensors 10 are illuminated as will be described in further detail below. In contrast, if the batteries 38 are instead supplying power to the microcontroller 40, then the LEDs 14 and 34 are not illuminated so that battery power may be conserved. A resistor 106 disposed between the wall-mounted transformer 36 and the input pin 104 of the microcontroller 40 and a resistor 108 disposed between the input pin 104 of the microcontroller 40 and a grounded terminal 109 are sized to divide the voltage supplied to the micrcontroller 40 so that, when powered by the wall-mounted transformer 36, the micrcontroller 40 receives a logic level one. If not powered by the wall-mounted transformer 36 then the microcontroller 40 receives a logic level zero.

A reset generator 110 used to ensure that the microcontroller 40 is powered up properly includes a first input 112 coupled to +3.3 volts, a second input 114 coupled to a grounded terminal 116 and a first output 118 coupled to the microcontroller 40 at an input pin 120. When the security system 9 is coupled to either the batteries 38 or to the wall-mounted transformer 36, the reset generator 110 causes the microcontroller 40 to remain in a non-operable state until the system voltage has reached the desired level of +3.3 volts.

An input pin 122 disposed on the microcontroller 40 which may be used for receiving interrupts is not used but instead tied to a logic level 1 using the 3.3 volt supply 100 and a pull-up resistor 124. To provide a local indication as to the operability and state of the main controller unit 22, the microcontroller 40 provides a constant logic level zero at an output pin 126 which is coupled to an LED 128 when the microcontroller 40 is powered up, but not in an alarm condition state. The LED 128 is further coupled, via a resistor 130, to the +3.3 volt supply 100 such that when the microcontroller 40 is powered up but not in an alarm condition state, the LED 128 is lit. When an alarm condition has been generated due to, for example, theft of an article, the microcontroller 40 generates a pulsed high level logic signal at the output pin 126 causing the LED 128 to flash on and off in an intermittent and pulsing manner. If instead the main controller unit 22 is not powered up, then the LED 128 remains unlit. Thus, security personnel can determine the power status and alarm status of the main controller unit 22 by referring to the state of the LED 128. As will be understood by one having ordinary skill in the art, a capacitor 127 may be tied between the voltage source 100 and ground to reduce noise that may otherwise occur on the conductor used to couple the voltage source 100 to the LED 128.

A key switch 130 disposed in the main controller unit 40 includes an LED 132 and a photo sensor 134. A pulsating voltage signal supplied from an output pin 136 disposed on the microcontroller 40 causes the LED 132 to turn on and off in an intermittent, pulsating manner. When a key (not shown) having a reflective cam surface (not shown) is inserted into a slot (not shown) disposed in the key switch 130, the light generated by the LED 132 is reflected onto the photo sensor 134 causing the photosensor 134 to generate a responsive signal that corresponds in duration to the length of the pulses by which the LED 132 is turned on and off. The responsive, pulsing signal is supplied from an output 138 of the key switch 130 to the microcontroller 40 via an input 140 and causes the microcontroller 40 to toggle from a first mode of operation, referred to as a standby mode, to a second mode of operation, referred to as an armed mode. In addition to using the signal received at the input 140 to toggle between modes, the microcontroller 40 further compares the signal to the signal supplied at the output pin 136 to the LED 132 of the key switch 130 to determine whether the photosensor 134 is indeed sensing a light signal emanating from the LED 132 or is instead merely responding to ambient light. If the signals are identical, then the microcontroller 40 responds by toggling between modes. If instead the signals are different, then the microcontroller 40 does not toggle modes and disregards the signal.

While in the armed mode, the microcontroller 40 is programmed to send a high voltage signal, i.e., a logic level one, to the splitter boxes 16 via an output pin 142 that is coupled to a first pin 144 disposed on the RJ-45 jack 28. Because the microcontroller 40 operates at +3.3 volts and the splitter boxes 16 operate at nine volts, the signal supplied to the first pin 144 of the RJ-45 jack 28 is actually stepped up from +3.3 volts to 9 volts at a voltage level shifter 146 before being supplied to the RJ-45 jack 28. As will be described in greater detail hereinafter, when an alarm condition is generated at one of the splitter boxes 16, the splitter box 16 with the alarm condition causes a load 148 (see FIG. 5) to be placed on a conductor (not shown) disposed in the cable 24 that is coupled to the first pin 144 disposed on the RJ-45 jack 28. As a result of this load 148, a transistor 150 coupled to the lead 152 extending from the first pin 144 of the RJ-45 jack 28 and further being coupled to an input pin 154 disposed on the microcontroller 40 turns on and thus begins to transmit current to the input pin 154 disposed on the microcontroller 40. To ensure that the proper voltage level is supplied to the microcontroller 40, a set of resistors 156 and 158 behave as voltage dividers thereby causing a voltage of approximately 4.5 volts, a logic level one, to appear at the input pin 154 when the transistor 150 is conducting which, in turn, causes the microcontroller 40 to sense the alarm. In response to the alarm, the microcontroller 40 causes an alarm signal to be transmitted from the microcontroller 40 to the horn 30. More particularly, the alarm signal is transmitted from an output pin 159 disposed on the microcontroller 40 to a voltage level shifter 160 that causes the voltage to be stepped up from 3.3 volts to 9 volts. The nine volt signal is then supplied to a resistor 162 which limits the current flow supplied to a transistor 164 which is biased at a terminal 166 by a nine volt signal. The voltage signal supplied at the input of the transistor 164 causes the transistor 164 to turn on and begin transmitting current that is supplied to the horn 30 causing the horn 30 to sound. The current is further supplied to the jack 32 which, as described above, may be used to power an external horn (not shown) that may be located remotely from the main controller unit 22. To prevent someone from disabling the external horn, a set of first and third pins 168, 170 disposed on the external horn jack 32 are directly connected to each other when the horn is disposed in the jack 32 and the third pin 170 is further coupled to a grounded terminal 172. In addition, the first pin 168 is coupled to the microcontroller 40 via an input pin 174 and via the output pin 142, which as described above, is set at a logic level one by the microcontroller 40 when the system is armed. As a result, when the external horn is disposed in the jack 32, current flow is enabled from the output pin 142 to the grounded terminal 172 causing a logic level zero to appear at the input pin 174. In contrast, when the external horn is removed from the jack 32, current flow is disabled through the jack 32 such that current flow proceeds from the input 142 through a set of resistors 175 and 176 to the input 174 causing a logic level one to appear at the input 174 which, in turn, causes the microcontroller 40 to sense an alarm condition. As described above, the microcontroller 40 responds to the alarm condition by causing the horn 30 to sound.

The standby mode is entered by removing the reflective cam portion of the key (not shown) from the key switch 130. While in the standby mode, the microcontroller 40 silences the horn 30 by removing a logic level one from the output pin 159 and further sets a timer (not shown) disposed in the microcontroller 40 for a predetermined length of time, such as, for example, two minutes. If after the timer goes off, the security system 9 is still in the standby mode, i.e., the microcontroller 40 senses a constant logic level zero at the input pin 138, then the microcontroller 40 causes the horn 30 to emit a series of beeps to alert security personnel that the security system 9 is disarmed.

The microcontroller 40 tracks information regarding the product sensors 10 that have been armed, i.e., attached to an article for monitoring, in a product sensor table stored in a memory (not shown) residing within the microcontroller 40. Specifically, the product sensor table tracks all of the product sensors 10 that have been armed for each splitter box 16 attached to the main controller unit 22. In addition, each product sensor 10 associated with the splitter box 16 has an assigned position and the product sensor table further includes information concerning the positions at which the armed sensors are located. Thus, for example, if there is one splitter box 16 attached to the main controller unit 22 and the splitter box 16 supports six product sensors 10 located in positions numbered one through six respectively, and five of the sensors that are located at positions one through five are armed, then the product sensor table includes information indicating that the five sensors located at positions one through five in the first splitter box 16 are armed. The microcontroller 40 receives this product sensor information from the splitter boxes 16 via the second pin 178 of the RJ-45 jack 28. A capacitor 182 provides noise filtering for the signal before it is received at the input pin 180 of the microcontroller 40. The information is formatted as a string of bits that are shifted into the microcontroller 40. Each bit location corresponds to a product sensor position and a logic level one indicates an armed sensor 10 is located at the corresponding product sensor position and a logic level zero indicates that an unarmed sensor or no sensor is located at the corresponding product sensor position. The string of informational bits received at the microcontroller 40 are stored in the product sensor table and are then transmitted from the microcontroller 40 back to the splitter boxes 16 via an output pin 184 which is coupled to a fourth pin 186 of the RJ-45 jack 28. Specifically, the string of bits transmitted via the output pin 184 are transmitted on the rising edge of the clock signal which, as described above, is derived from the oscillator disposed in the microcontroller 40 and is transmitted to the splitter boxes 16 via the output pin 48 that is coupled to the seventh pin 50 of the RJ-45 jack 28. As described with respect to the output supplied by the first pin 142 of the microcontroller 40, the output signal supplied from the output pin 184 to the fourth pin 186 of the RJ-45 jack 28 and the clock signal supplied on the output pin 48 of the microcontroller 40 to the seventh pin 50 of the RJ-45 jack 28 are shifted from 3.3 volt signals to nine volt signals at a set of voltage level shifters 188, 190, respectively. The information transmitted from the microcontroller 40 back to the splitter boxes 16 is also formatted as a string of bits, each bit location representing a corresponding product sensor position and the logic level at the bit location indicating whether the corresponding product sensor 10 is armed or not. A resistor 191 couples the input pin 180 of the microcontroller 40 to the output pin 184 of the microcontroller 40. Thus, when no splitter boxes 16 are attached to the main controller unit 22, the output information supplied at the output pin 184 will equal the input information received at the input pin 180. A resistor 192 causes the voltage signal to be reduced from 9 volts to a voltage level suitable for the microcontroller 40. As a result, the microcontroller 40 is programmed to compare the data received at the input pin 180 to the data transmitted at the output pin 184 so that the microcontroller 40 is informed when no splitter boxes 16 are attached.

To protect against an over-voltage condition, a diode 193 coupled between Vdd (i.e., 9 volts) and a grounded terminal 194 shunts current to ground if the voltage source Vdd exceeds about 10.1 volts. In addition, a set of resistors 196, 198, 200 are used to limit current flow from the splitter boxes 16 via RJ-45 jack 28 to the microcontroller 40. A self-resetting fuse 202 is further coupled to the fifth pin 204 of RJ-45 jack 28 to protect against over-current condition caused by, for example, a short circuit occurring in one of the splitter boxes 16. Thus, the fuse 202 will disconnect the splitter boxes 16 from the main controller unit 22 in the event of an over-current condition and the fuse 202 will reconnect the splitter boxes 16 to the main controller unit 22 when a desirable current level is again reached.

An external key switch 210 may be coupled to the microcontroller 40 via an input pin 212 and may be used to prevent unauthorized arming or disarming of the security system 9. More particularly, the microcontroller 40 may be programmed to operate only in the event that a logic level 0 is supplied to the input pin 212 of the microcontroller 40, wherein the logic level 0 is only obtained by turning an authorized key in the external key switch 210. Specifically, turning the key in the key switch 210 causes a pin 214 on the key switch 210 to be coupled to a pin 216 which is further coupled to the grounded terminal 172. Further, because the pin 214 is coupled to the input pin 212, the input pin 212 is also connected to ground causing a logic level zero to appear at the input pin 212. In contrast, when the key is not used, then the pin 214 is disconnected from ground causing an open circuit through the key switch 210. As a result, current flows from the voltage source 100, Vcc, through a resistor 218 and a resistor 220 which is coupled to the input pin 212 thereby causing a logic level 1 to appear at the input pin 212 of the microcontroller 40 which, in turn, causes the microcontroller 40 to be inoperable. A capacitor 222 coupled between the input pin 212 and the external key switch 210 filters electrical noise, such as current spikes that might otherwise occur at the input pin 212 due to, for example, static electricity generated at the external key switch 210. Further, the operation of the external key switch 210 and the internal key switch 130 may be mechanically linked so that if either key 130 or 210 is placed in the standby mode, regardless of the position occupied by the other key 130 or 210, the system 9 is placed in the standby mode.

Referring now to FIGS. 4A–D, the splitter box 16 includes an alarm logic circuit 226 having a set of six identical product sensor logic circuits 228. Each product sensor logic circuit 228 includes an RJ-11 jack 20, having a set of six pins 234, 236, 238 and 240 (two of the pins are not used), into which a product sensor 10 may be plugged. When a product sensor 10 is plugged into the RJ-11 jack 20 and when the switch 12 (see FIG. 1) disposed in the product sensor 10 is closed due to attaching the product sensor 10 to an article, the second pin 234 in the RJ-11 jack 20 and the fifth pin 240 in the RJ-11 jack 20 become connected together such that current flow is enabled between the second and fifth pins 234 and 240. Further, as described with respect to FIG. 1, when the system is armed, the microcontroUer 40 provides an alarm sensing signal to the splitter boxes 16 via the second pins 178, 178A of the RJ-45 jacks 28, 28A that is at a constant logic level one. Because the RJ-45 jack 28 disposed in the main controller unit 22 connects to the RJ-45 jack 28A disposed in the splitter box 16, the pins associated with the RJ-45 jack 28 A disposed in the splitter box 16 are given the same reference numerals (with an additional "A") as the reference numerals assigned to the pins disposed in the RJ-45 jack 28 that is located in the main controller unit 22. When received at the splitter box 16, the alarm sensing signal is supplied to a transistor 242 and causes the transistor 242 to turn on and begin conducting current. As a result, a set of input pins 244, 246 of a NAND gate 248 are tied to a grounded terminal 250, thus providing a logic level zero at both inputs 244, 246 of the NAND gate 248 and causing the output terminal 252 of the NAND gate 248, in turn is coupled to a set of six pull-up resistors 254, each of which is disposed in one of the product sensor logic circuits 228. Each of the pull-up resistors 254 is further the fifth pin 240 of the RJ-11 jack 20. Thus, provided that the product sensor 10 is not attached to an article to be monitored such that the switch 12 disposed therein is open, then the fifth pin 240 of the RJ-11 jack 20 is an open circuit. As a result, current flow proceeds from the pull-up resistor 254 to the input pin 256 of the switch status shift register 258 causing a logic level one to be supplied to the input pins 256 of the switch status shift register 258. Thus, when the product sensors 10 are not engaged, i.e., not attached to an article, a logic level one corresponding to each disengaged product sensor is supplied to the switch status shift register 258.

When the product sensors 10 are engaged, i.e., are attached to an article, then, as described above, a short circuit is created between the second and fifth pins 234, 240 of the RJ-11 jack 20 and, because the second pin 234 of the RJ-11 jack 20 is tied to a grounded terminal 260, the pull-up resistors 254 are tied to ground via the fifth and second pins 234, 240 of the RJ-11 jack 20 and a logic level zero is supplied to the corresponding input pin 256 of the switch status shift register 258. Thus, when the product sensor switch 12 is engaged, a logic level zero is supplied to the corresponding input pin 256 of the switch status shift register 258. As a result, the status (open or closed) of each product sensor switch 12 is stored in the switch status shift register 258. In addition, the switch status shift register 258 supplies the product sensor status information to the microcontroller 40 via a lead 262 coupled to the second pin 178A of the RJ-45 jack 28A. More particularly, the switch status shift register 258 may operate in either a parallel load mode wherein data may be supplied to the set of parallel input pins 256 disposed on the switch status shift register 258 or may operate in a shift mode wherein the data supplied via the parallel input pins 256 is shifted out of the switch status shift register 258 in a serial fashion. An input pin 264 allows the switch status shift register 258 to toggle between the two modes of operation. Specifically, the clock signal supplied by the microcontroller 40 to the seventh pin 50 of the RJ-45 jack 28 is supplied to a transistor 266 disposed in the splitter box 16. When the clock line goes high, the transistor 266 turns on causing current to flow through a resistor 268 which, in turn, generates a voltage that causes a capacitor 270 to charge up. The voltage signal generated using the resistor 268 is further supplied as a logic level one to an inverter 272 that causes the signal to be inverted so that a logic level zero occurs at an output 274 of the inverter 270 which is supplied to the input pin 264 disposed on the switch status shift register 258 that causes the switch status shift register 258 to toggle between modes. Specifically, a logic level zero supplied to the input pin 264 causes the switch status shift register 258 to enter the shift mode thereby causing the data supplied to the parallel input pins 256 of the switch status shift register 258 to be latched and then shifted in a serial mode out of the shift register 258 via an output pin 276 that is supplied to the second pin 178A on the RJ-45 jack 28A disposed in the splitter box 16. The data is shifted one bit position left for each clock pulse and the switch status shift register 258 remains in the shifting mode for as long as the input pin 264 remains low, i.e., for as long as it takes for the capacitor 270 to discharge. The serially shifted data is thereafter supplied to pin 180 of the microcontroller 40 as described above. The clock pulse signal generated by the microcontroller 40 and supplied to the splitter box 16 on the seventh pin 50 of the RJ-45 jack 28 is supplied to a clock signal input pin 278 disposed on the switch status shift register 258 thereby allowing the switch status shift register 258 and the microcontroller 40 to operate synchronously. An input pin 280 of the switch status shift register 280 is further coupled to a second pin 178B on the RJ-45 jack 28 B that is coupled to another splitter box 16 and allows product sensor status data to be shifted from the downstream splitter boxes 16 to the microcontroller 40. In addition, a first of the parallel input pins 257 is tied to the voltage source Vdd thereby causing a logic level one to appear at the input pin 257. Upon receiving the shift register sensor data from the switch status shift register 258, the microcontroller 40 is programmed to examine the location at which this bit is located to determine whether a splitter box 16 is coupled to the main controller unit 22. Thus, by tying the input pin 257 to ground, the microcontroller 40 is able to distinguish between an attached splitter box 16 to which no sensors 10 have been coupled and the absence of a splitter box 16. As described with respect to FIG. 3, the product sensor status data received at the microcontroller 40 is subsequently stored in a product sensor table.

In addition to supplying product status information to the microcontroller 40, the splitter boxes 16 are further equipped to receive product sensor status information from the microcontroller 40 via the pin 186 of the RJ-45 jack 28. Specifically, the corresponding pin 186A on the RJ-45 jack 28A disposed in the splitter box 16 is supplied to an LED status shift register 282 via an input pin 284 which receives the string of data bits representing the product sensor status information stored in the product sensor table. However, as will be described in greater detail below, for purposes of making the data suitable for usage by the product sensor logic circuits 228, the data bits are inverted by the microcontroller 40 before being transmitted to the LED status shift register 282. Thus, a logic level one is used to indicate that a product sensor 10 is engaged and a logic level zero is used to indicate that a product sensor 10 is disengaged. The string of data bits are shifted into the LED status shift register 282 at a rate of one bit per clock pulse, such that each bit shifts one position to the right during each clock pulse. A pin 286 disposed on the LED status shift register 282 receives the clock signal supplied by the microcontroller 40 via pins 50, 50A of the RJ-45 jacks 28, 28A and an input pin 288 disposed on the LED status shift register 282 is coupled to the output terminal 274 of the inverter 272 so that the LED status shift register 282 and the switch status shift register 258 begin shifting data at the same time. An output pin 290 disposed on the LED status shift register 282 allows the data to further be shifted to downstream splitter boxes 16 via the RJ-45 jack 28B. When all of the product sensor status data has been shifted into the LED status shift register 282, the LED status shift register 282 latches the data and causes the data to be output on a set of parallel output pins 292, each corresponding to one of the product sensors 10. Actually, the voltage source Vdd must be tied to the input pin 291 disposed on the LED status shift register 282 in order to allow the data stored in the LED status shift register 282 to be coupled to the parallel output pins 292. A first parallel output pin 294 disposed on the LED status shift register 282 is not used to latch data corresponding to the status of one of the product sensors 10 but is instead used to store data that indicates whether the system is being powered via the wall-mounted transformer 36 or via the batteries 38. Specifically, as described with respect to FIG. 3, the microcontroller 40 includes an input pin 104 that senses a logic level one when the security system 9 is receiving power from the wall-mounted transformer 36 and a logic level zero when the system 9 is receiving power from the batteries 38. The microcontroller 40 places a bit indicating this power supply status information into the string of data bits that represent the status of the product sensors 10 at a location that causes the power supply status bit to be supplied via the first parallel output pin 294 disposed on the LED status shift register 282.

The product sensor status information supplied at the parallel output pins 292 disposed on the LED status shift register 282 is provided to the product sensor logic circuits 228, and, more particularly, each product sensor status bit is supplied to the product sensor logic circuit 228 associated with the corresponding product sensor 10. Specifically, the status bit is supplied to an input pin 296 disposed on a NAND gate 298 in the corresponding product sensor logic circuit 228. The NAND gate 298 further includes an input pin 300 that is coupled, via the resistor 260, to the pull-up resistor 254 and that is further coupled to the corresponding input pin 256 of the switch status shift register 258. As described previously, initially, when the product sensor 10 is engaged, a logic level one is supplied to the input pin 256 that is coupled to the input pin 300 of the NAND gate 298. Then, when the product sensor 10 is engaged, a logic level zero is supplied to the input pin 300 of the NAND gate 298. Thus, assuming that the product sensor 10 is engaged, a logic level zero is supplied to the input pin 300 of the NAND gate 298. Further, assuming that the product sensor status information has been shifted to the microcontroller 40 and then shifted back to the LED status shift register 282 as described, then a logic level one is supplied to the input 296 of the NAND gate 298 causing a logic level one to be supplied at an output terminal 302 of the NAND gate 298. If the product sensor 10 subsequently becomes disengaged, then, as described earlier, a logic level one is supplied to the corresponding input 256 of the switch status shift register 258 and thus to the input 300 of the NAND gate 298, thereby causing the output terminal 302 of the NAND gate 298 to become a logic level zero. When the output terminal 302 of the NAND gate 298 is at a logic level zero, current flow is enabled from the NAND gate 298 to a transistor 304. Specifically, an output pin (not shown) disposed on the NAND gate 298 shunts the current away from the NAND gate 298 to a terminal 306 when the NAND gate output terminal 302 is at a logic level zero. The flow of current to the terminal 306 causes the transistor 304 to turn on thereby causing current to flow from the output pin 142 of the microcontroller 40 through the transistor 304 to a grounded terminal 308. Before reaching the transistor 304, the current flows through the load resistor 148. Thus, disengaging a previously engaged product sensor 10 causes the load 148 to be placed on the output pin of 142 of the microcontroller 40 which is used to sense an alarm condition. As described with respect to FIG. 3, the presence of the load 148 is sensed by the microcontroller 40 via the input pin 154 which causes the microcontroller 40 to stop the clock and to sound the horn 30 as described above. Because the microcontroller 40 stops the clock immediately upon sensing an alarm signal on the input pin 154, the microcontroller has no knowledge of which sensor 10 has become disengaged causing the alarm signal to be generated.

The product sensor logic circuit 228 further includes circuitry for activating the LEDs 14 and 34. Specifically, the product sensor logic circuit causes the LEDs 14 and 34 to be activated when the security system 9 is powered by the wall-mounted transformer 36 and when the product sensors 10 are engaged thereby to indicate the engaged status of the product sensors 10. As described above, the output pin 294 disposed on the LED status shift register 282 is set at a logic level one when the security system 9 is powered via the wall-mounted transformer 36. A lead coupled to the output pin 310 causes the logic level to be coupled to a resistor 312 that is further coupled to a transistor 314 disposed in the product sensor logic circuit 228. The logic level one causes a voltage to appear across the resistor 312 thereby causing the transistor 314 to turn on and begin transmitting current. As a result, current flow is enabled from the voltage source Vdd coupled to the third pin 236 of the RJ-11 jack 20 through a resistor 316, the LED 34, the transistor 314 and then to the fifth pin 240 of the RJ-11 jack 20 which, as described above, is coupled to the second pin 234 of the RJ-11 jack 20 and, thus, ground when the product sensor 10 is engaged. The current flow through the described circuit path causes the LED 34 to activate thereby indicating that the product sensor 10 is engaged. In addition, when the transistor 314 is conducting current, current flow is further enabled through the LED 14 which is disposed in the product sensor 10 and connected to the RJ-11 jack 20 between the third and fourth pins 236 and 238. As a result, the LED 14 disposed in the product sensor 10 is also illuminated when the product sensor switch 12 is closed. In contrast, if the security system 9 is instead powered via the batteries 38, the LED status shift register 282 provides a logic level zero at the output 294 such that the transistor 314 is not turned on. As a result, current flow through the LEDs 14 and 34 is not enabled so that the LEDs 14, 34 are not activated and battery power is conserved. As will be understood by one having ordinary skill in the art, the LEDs 14, 34 provide the largest load on the batteries 38, thus this power saving feature can significantly increase the life of the batteries 38. As will further be understood by one having ordinary skill in the art, because the voltage level at the output terminal 302 of the NAND gate 298 is approximately Vdd when a logic level one is at the output terminal 302 of the NAND gate 298, current flow from the voltage source Vdd to the output terminal 302 of the NAND gate 298 is disabled. Further current flow from the output terminal 302 of the NAND gate 298 to the fourth pin 238 of the RJ-11 jack 20 is prohibited by a diode 318 placed at the output terminal 302 of the NAND gate 298. Thus, when the NAND gate 298 is not sensing an alarm condition, i.e., the output terminal 302 of the NAND gate 298 is at a logic level one, the LEDs 14 and 34 will not be activated unless the output pin 294 is set to provide a logic level one. However, after an alarm signal has been sensed by the microcontroller 40, in addition to stopping the clock and sounding the horn 18, the microprocessor 40 further causes a series of pulses at a rate of four pulses per second to be generated on the output pin 142 of the microcontroller 40. As described above, the pulsing signal is supplied to the transistor 242. Further, the pulsing nature of the signal causes the transistor 242 to turn on and off which causes the inputs 244, 246 supplied to the NAND gate 248 to fluctuate between logic level zero when the transistor 248 is on, causing the inputs 244, 246 of the NAND gate 248 to be tied to ground, and a logic level one when the transistor is off such that current flow is enabled from the voltage source Vdd through the resistor 260 to the inputs 244, 246 of the NAND gate 248. Thus, the output terminal 252 of the NAND gate 248 fluctuates between a logic level zero and a logic level one. When the NAND gate output terminal 252 is at a logic level one, and the product sensor switch 12 is disengaged, current flow from the output terminal 252 of the NAND gate 248 to the input terminal 300 of the NAND gate 298 is enabled causing the input terminal 300 of the NAND gate 298 to be set at a logic level one. Thus, both inputs 300, 296 to the NAND gate 298 are set at a logic level one causing the output terminal 302 of the NAND gate 298 to be set at a logic level zero. This, in turn, causes the voltage at the output terminal 302 of the NAND gate 298 to be set at zero so that current flow is enabled between the voltage source Vdd and the output terminal 302 of the NAND gate 298 thereby causing the LEDs 14 and 34 to become activated. In contrast, when the NAND gate output terminal 252 switches to a logic level zero, the input pin 300 also becomes a logic level zero causing the output terminal 302 of the NAND gate 298 to become a logic level one thereby disabling current flow between the output terminal 302 of the NAND gate 298 and deactivating the LEDs 14 and 34. Thus, when a product sensor 10 has become disengaged causing an alarm signal to be generated, the microcontroller 40 also causes the LEDs 14, 34 associated with the disengaged product sensor 10 to blink on and off thereby allowing security personnel to easily identify the product sensor 10 that has become disengaged.

An input pin 293 disposed on the LED status shift register 282 is coupled to a circuit 295 that is logically equivalent to the product sensor logic circuit 228. However, instead of being used to generate an alarm signal when a product sensor has been disengaged or otherwise disconnected from the splitter box 16, the circuit 295 causes an alarm signal to be generated when the downstream splitter box 16 has been removed from the security system 9. Due to the similarity between the circuit 295 and the product sensor logic circuit 228, the circuit 295 also causes the alarm signal to be generated by causing the load 148 to be placed on the alarm sensing line that is coupled to the microcontroller 40. Thus, when reconfiguring the system 9, the main controller unit 40 should be placed in the standby mode to avoid inadvertantly generating an alarm signal.

Preferably, though not necessarily, the microcontroller 40 further includes a sleep mode that may be initiated, for example, when the microcontroller is drawing power from the batteries 38. During the sleep mode, a processor (not shown) disposed in the microcontroller 40 enter a low power consumption state wherein the processor is not performing the signal monitoring tasks described above but is instead in a substantially inactive state. A watchdog timer (disposed in the processor) periodically causes the processor to become active and perform the signal monitoring duties described above. Unless an alarm is sensed during this active period, the processor goes back to the inactive, sleep mode. As will be understood by one having ordinary skill in the art, microcontrollers having sleep mode capabilities are well known in the art and thus are not described further herein.

Figure 5:
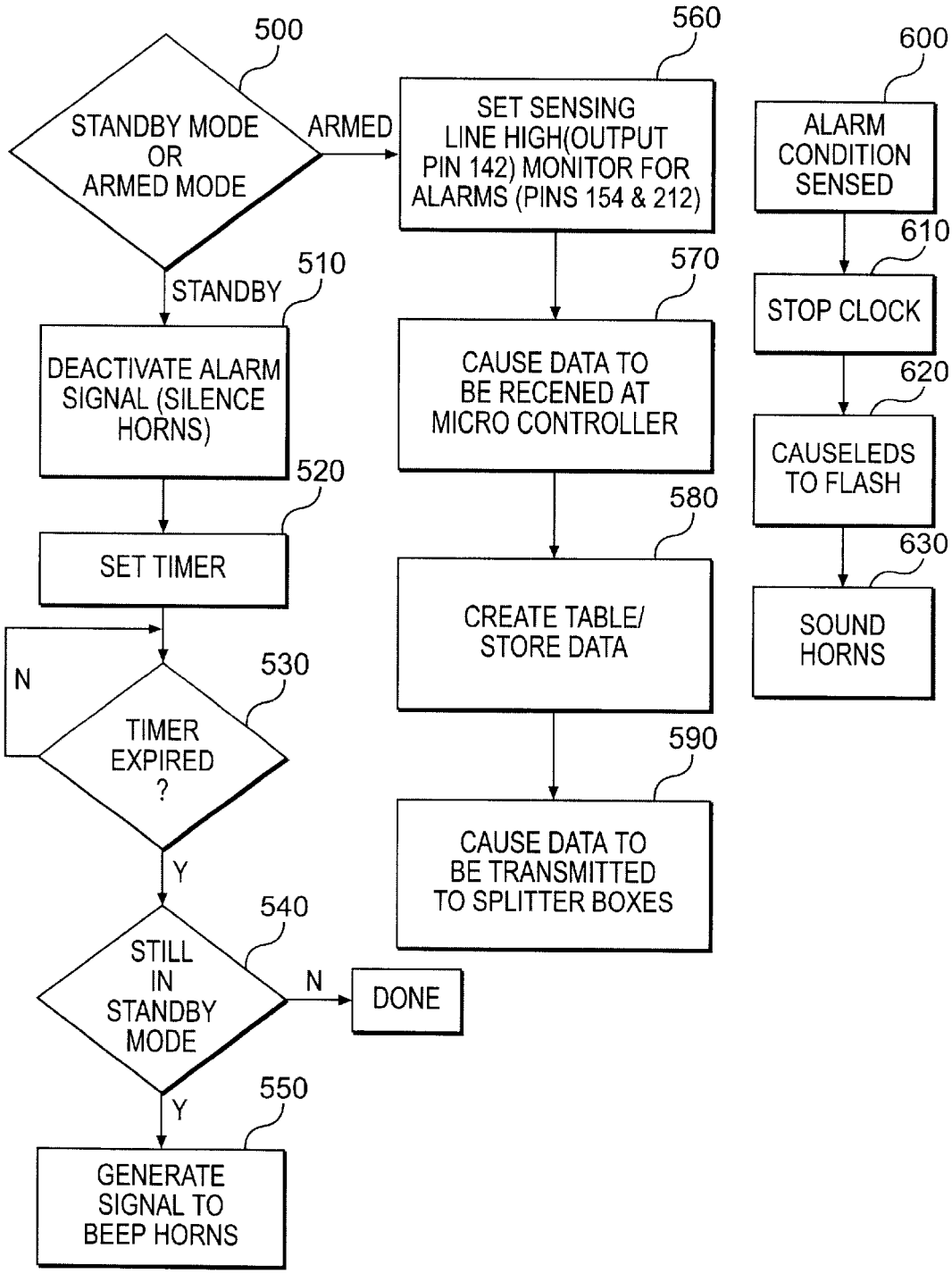
FIG. 5 is a logic diagram that illustrates a method for using the security system of the present invention.

Referring now to FIG. 5, a method for monitoring an article using the security system 9 may be implemented by programming a processor (not shown) disposed in the microcontroller 40 to perform a set of steps that may begin, for example, at a step 500 at which the microcontroller 40 checks to determine whether the main controller unit 22 has been placed in the standby mode or in the armed mode. If placed in the standby mode, then the microcontroller 40 deactivates alarm signals generated at output pins 154 and 212 (if previously activated) thereby silencing the horn 30 and an external horn connected to the jack 32 at a step 510. Next, at a step 520, the microcontroller 40 causes a timer disposed in the microcontroller 40 to be set for a predetermined length of time. When the timer reaches the predetermined time at the steps 530, the microcontroller 40 checks to determine whether the main controller unit 22 is still in the standby mode at a step 540 and, if so, then causes the horns 130 and 210 to generate a series of beeps at a step 550 so that security personnel are informed that the security system 9 is not armed. The microcontroller 40 continues to cause the horns to sound until the system is armed or power is removed from the system 9. Of course, if the main controller unit 22 is no longer in the standby mode at the step 540 then no additional action is taken by microcontroller 40 regarding the timer. If, at the step 500, the microcontroller 40 instead determines that the main controller unit 22 has been placed on the armed mode, then the micorcontroller 40 causes an alarm sensing line to be high, i.e., set to a logic level one, at a step 560 by placing a logic level one on the output pin 142 as described above. In addition to placing the logic level one at the output pin 142, the microcontroller begins to monitor the input pin 154 for an alarm signal generated by a splitter box 16. In addition, the microcontroller 40 monitors the input pin 212 for an alarm signal generated by the jack for the external horn 32. Note that the microcontroller 40 continues to hold the alarm sensing line (output pin 142) at a logic level one, and to monitor the input pins 154 and 212 until an alarm condition is sensed. Next, at a step 570 microcontroller 40 causes a clock signal to be supplied to the splitter boxes 16 to shift sensor status data to the microcontroller 40. Assuming that the main controller unit 22 has just entered the armed mode after having been in the standby mode, after receiving the sensor status data, the microcontroller 40 creates a table for storing the sensor status data at a step 580. More particularly, the microcontroller 40 creates a table having a number of storage locations equal to the number of sensors 10 coupled to the splitter boxes that are coupled to the microcontroller. When creating the table, the microcontroller 40 enters the data into the table such that the status, i.e., open or closed, of each sensor 10 coupled to the security system 9 is recorded therein. As will be understood by one having ordinary skill in the art, the security system 9 may be programmed to sample the sensor status data received from the splitter box 16 in manner that reduces data error to do noise. For example, the microcontroller 40 may be programmed to receive and store three or four sets of sensor status data, take the average of the three or four data sets for each bit location, and record the average of the three or four data sets in each bit storage location disposed in the table. After creating the table and storing the data, at a step 590, the microcontroller 40 causes the data to be transmitted to the LED status shift register 282 disposed in each splitter box. The microcontroller 40 then continues to repeat steps 560, 570 and 580 until an alarm condition is sensed. The microcontroller 40 may be programmed to add storage locations to the table when additional splitter boxes 16 are coupled to the security system 9. As described above, in addition, to receiving, storing and transmitting the sensor status data, the microcontroller 40 also continues to monitor for an alarm signal at input pins 154 and 212 until an alarm signal is sensed. Note that in addition to performing the above identified steps, the microcontroller 40 may additionally be programmed to generate a signal that indicates whether the security system 9 is being powered by the wall-mounted transformer 36 or by the batteries 40 so that, if using battery power, the product sensor logic circuits 228 cause the LEDs 14 and 34 to be disabled, thereby conserving battery power.

Upon receiving an alarm signal at a step 600 which may be occur simultaneously with any of the steps 550–580, the microcontroller 40 causes the system clock to stop at a step 610. As a result, no further data is collected from the splitter boxes 16 by the microcontroller 40 and, thus, the microcontroller 40 is not able to determine which of the product sensors 10 has become disengaged. After stopping the clock, the microcontroller 40 causes a pulsing signal to be transmitted via the output pin 142 at a step 620 which, in turn, causes the LEDs 14 and 34 associated with the disengaged sensor 10 to blink on and off in an intermittent fashion so that security personnel may easily identify the disengaged sensor. Next, at a step 630, the microcontroller 40 causes the horn 30 and the external horn disposed in the jack 32 to be sounded so that security personnel are alerted to the presence of the disengaged sensor. The microcontroller 40 continues to sound the horn 30 and the external horn and continues to cause the LEDs 14 and 34 to flash until the main controller unit 22 is placed in the standby mode. As will be appreciated by one having ordinary skill in the art, the steps 620 and 630 may be performed in any order relative to each other.

As will be understood by one having ordinary skill in the art, the security system 9 does not only generate an alarm signal in response to a sensor 10 becoming disengaged but is configured to generate an alarm signal whenever current flow between the second and fifth pins of the RJ-11 jack 230 are removed which may occur, for example, if the cable 18 leading to the sensor 10 is cut, if the sensor 10 is completely removed from the RJ-11 jack 230 or if the sensor switch 12 becomes disengaged from the article to which it was previously attached.

Figure 6A:
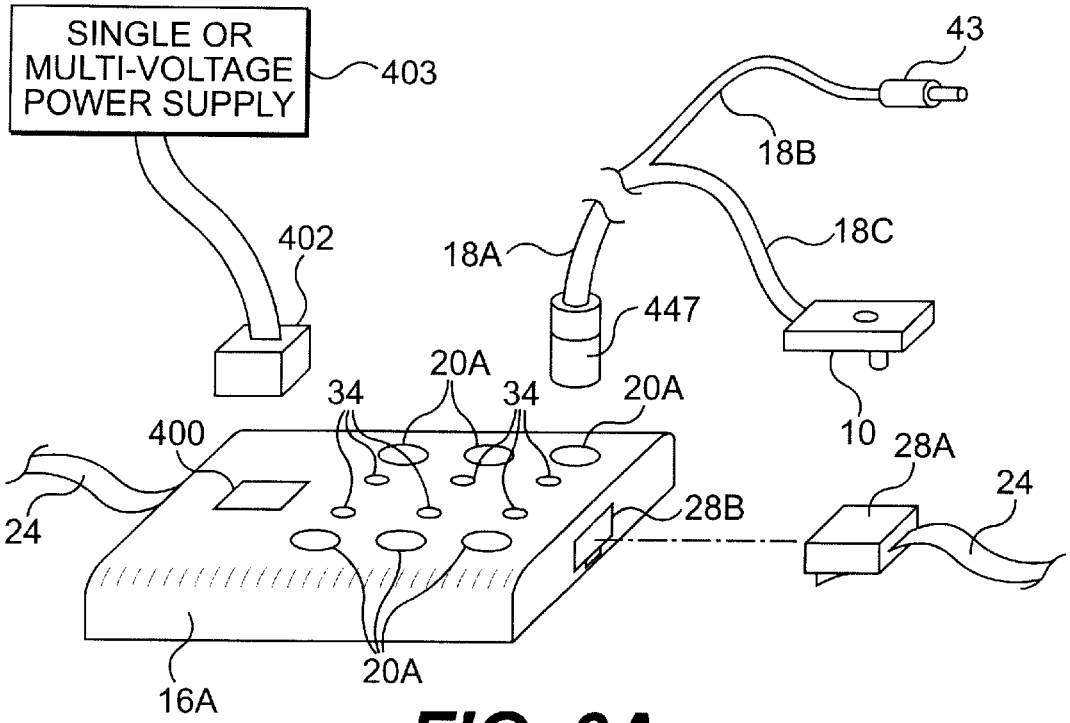
FIG. 6A is a perspective view of another embodiment of a splitter box of the invention.
Figure 6B:
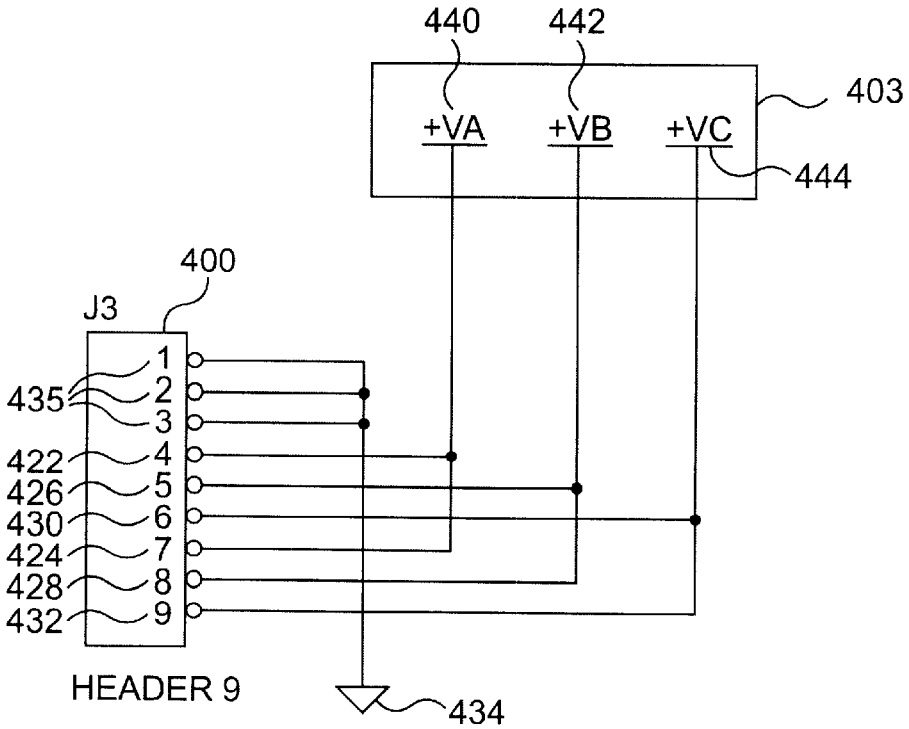
FIG. 6B is an electrical schematic of power input port disposed in the splitter box of FIG. 6A.
Figure 7A:
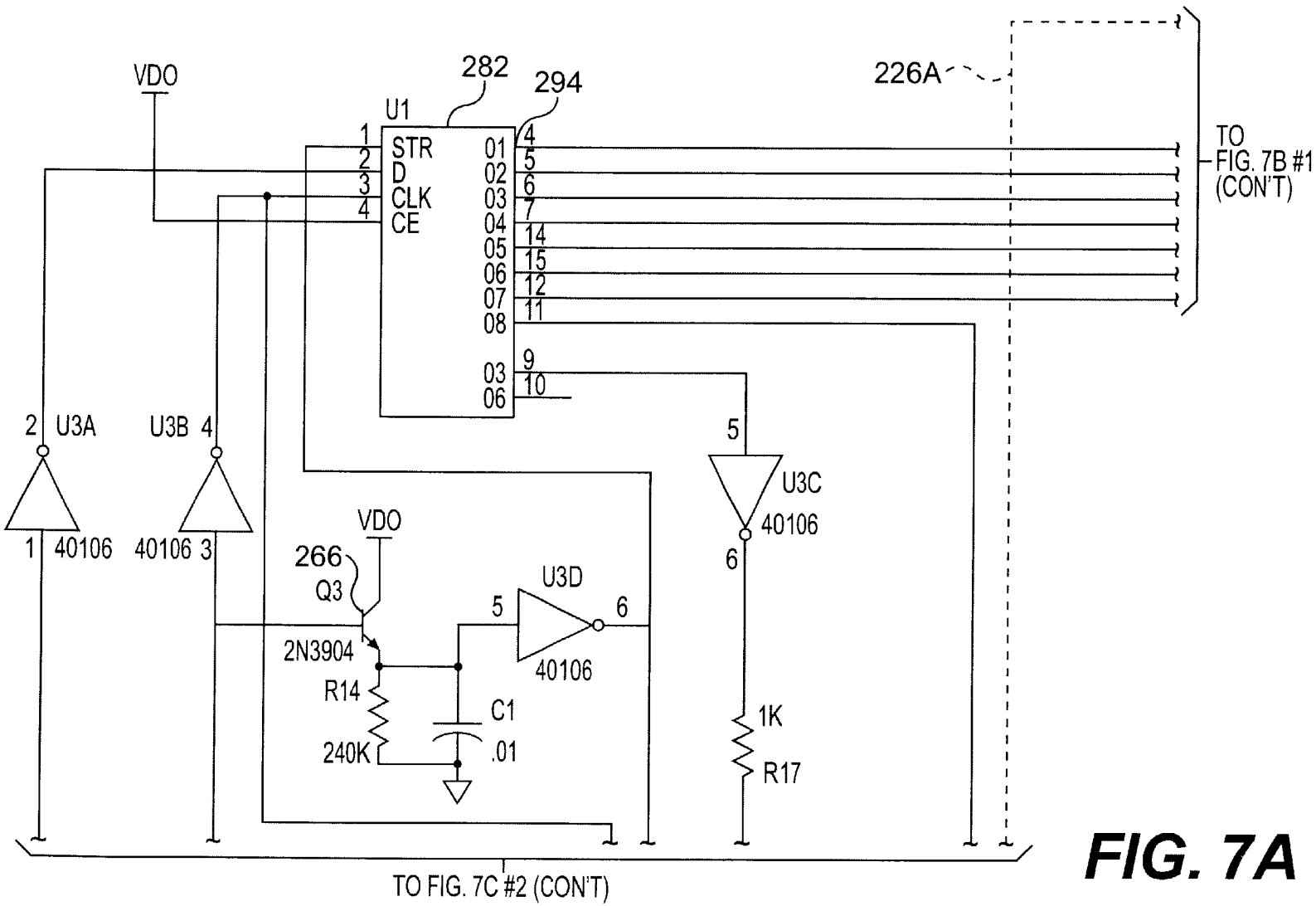
FIGS. 7A–D are power circuit diagrams of the splitter box of FIG. 6A.
Figure 7B:
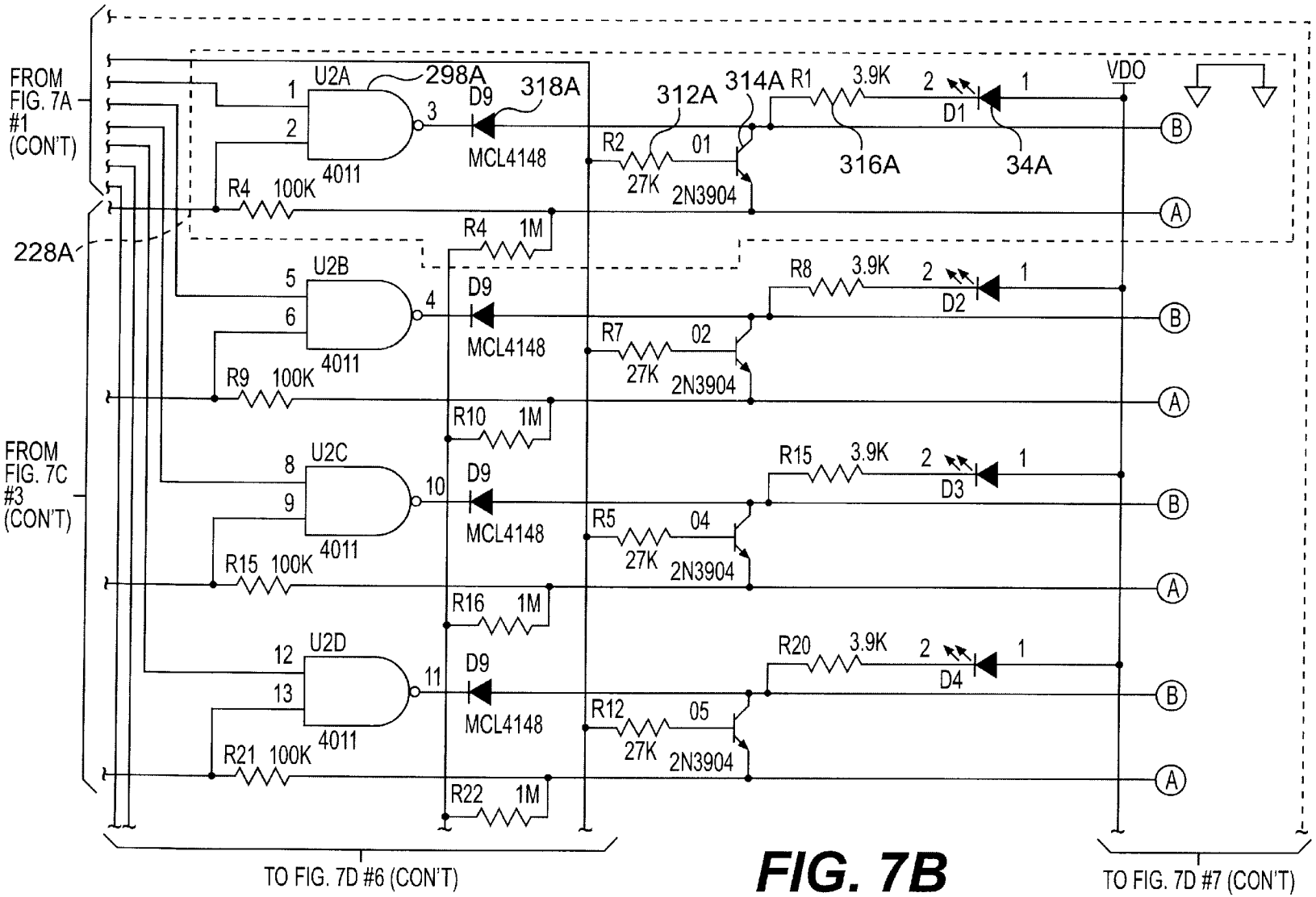
Figure 7C:
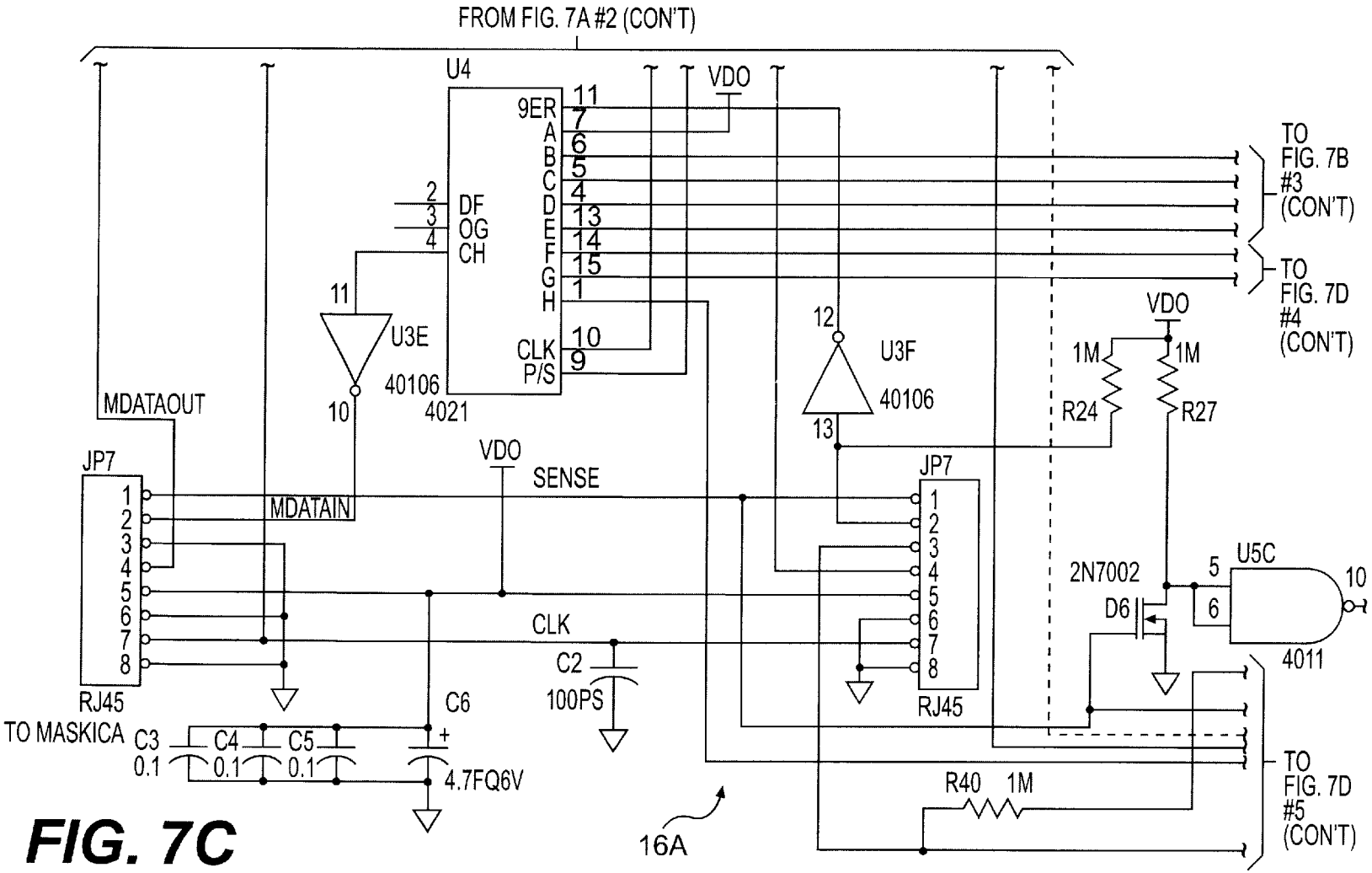
Figure 7D:
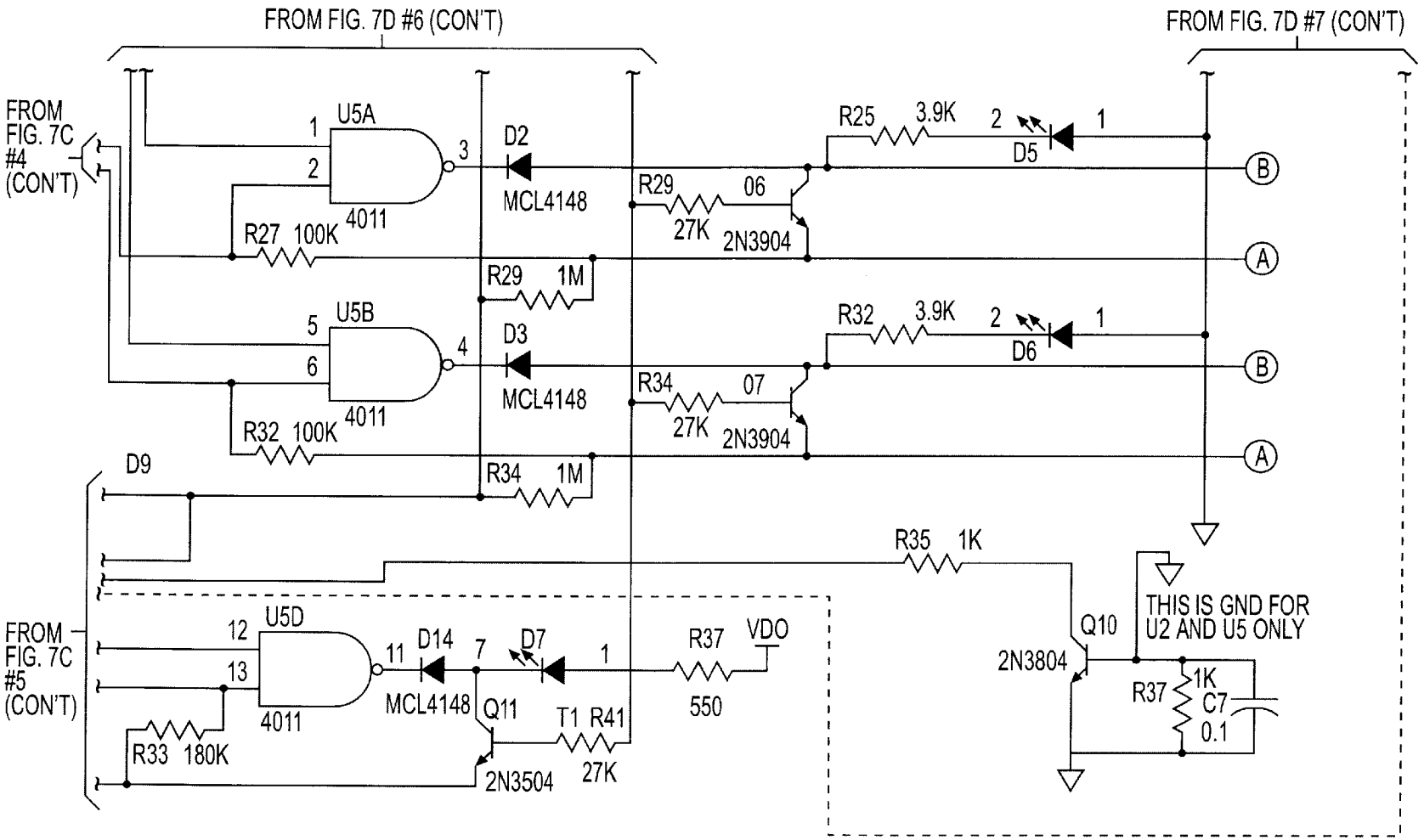

Referring now to FIG. 6, a splitter box 16A in accordance with another embodiment of the present invention incorporates a power supply for supplying power to the articles being protected by the present security system. In addition to the above-described features of the splitter box 16, the splitter box 16a has a power port 400 which is configured and adapted to receive a power plug 402 from an external power source 403. The power source 403 may be a single or multi-voltage power supply. For example, if three different voltage levels are desired, a set of pins 422, 424 may be coupled to receive a set of power signals delivered at a first voltage level 440, a set of pins 426, 428 may be coupled to receive a set of power signals delivered at a second voltage level 442, and a set of pins 430, 432 may be coupled to receive a set of power signals delivered at a third voltage level 444. The power port 400 may further include, for example, three pins 435 that are tied to a grounded terminal 434. Power input through the power port 400 is supplied to each sensor port 20A and thereafter delivered via a set of conductors 18A and 18B to the product sensor 10 as will be described further below.

Figure 8A:
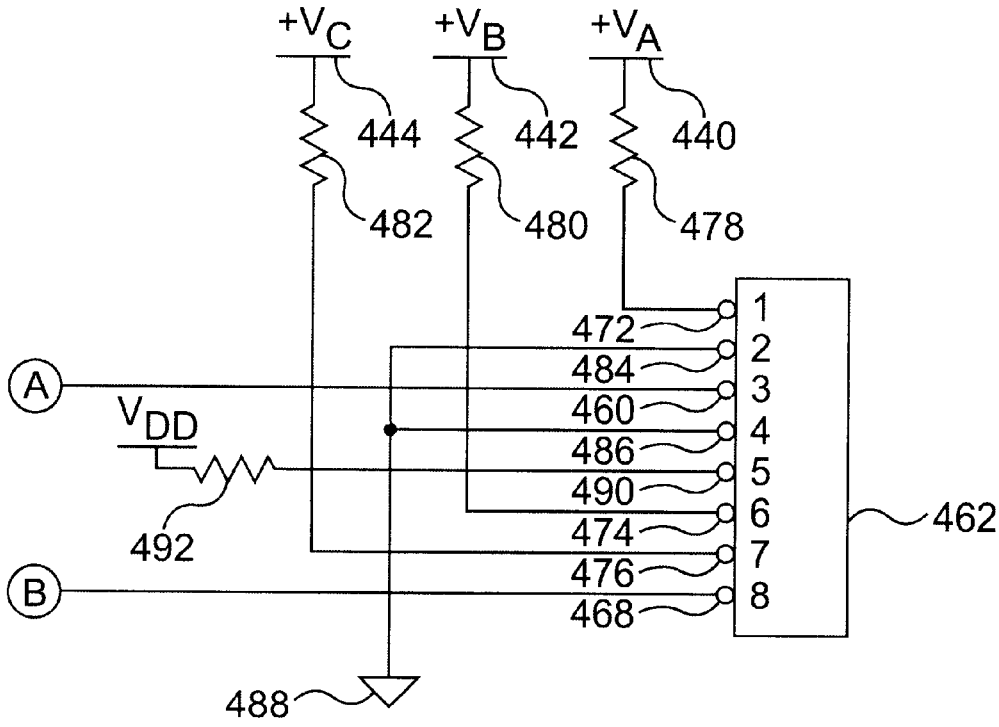
FIG. 8A is an electrical schematic of an output jack that may be disposed in the splitter box of FIG. 7.
Figure 8B:
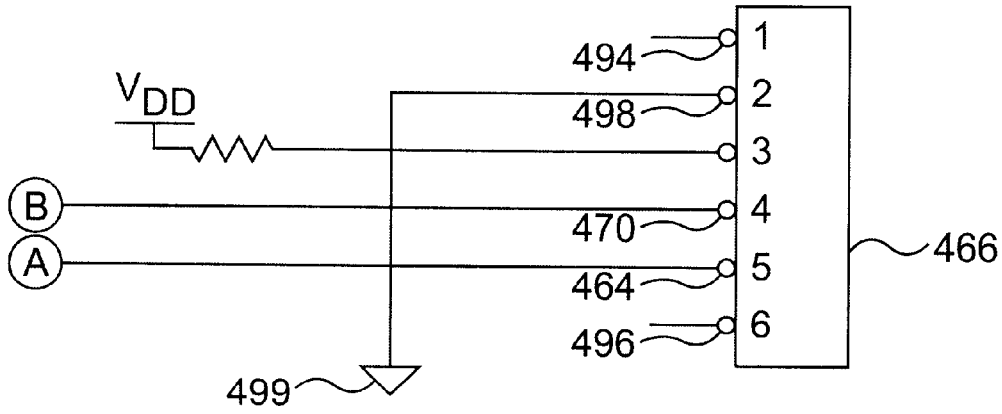
FIG. 8B is an electrical schematic of an output jack that may be disposed in the splitter box of FIG. 7.

Referring also to FIGS. 7A–D an alarm control logic circuit 226A disposed in the splitter box 16A is logically equivalent to the alarm control logic circuit 226 disposed in the splitter box 16 except that a portion of the product sensor logic circuit 228 that is disposed downstream of the NAND gate 298 and the resistor 254 is arranged differently in the splitter box 16A than it is arranged in the splitter box 16. As will be understood by one having ordinary skilled in the art, although the product sensor logic circuit 228A disposed in the splitter box 16A is arranged differently than the logic circuit 228 disposed in the splitter box 16, the resulting logic is the same such that the a security system implemented using the splitter box 16A will operate in a manner that identical to a security system implement using the splitter box 16. The output of the NAND gate 298A is coupled to the diode 318A which is further coupled to the resistor 316A. The resistor 316A is also coupled to the LED 34A which is coupled to a voltage source Vdd. Referring also to FIGS. 8A and 8B which are intended to align with FIG. 7 via the connecting points A and 8, the output of the NAND gate 298A is further coupled to an eighth pin 468 of a jack 462 that is adapted to supply power to the product being monitored or may instead be coupled to a fourth pin 470 of an RJ-11 jack 466. The output pin 294 of the LED status shift register is coupled to the resistor 312A which is coupled to the transistor 314A. In addition, the transistor 314 is further coupled to a third pin 460 of the jack 462 or may instead be coupled to a fifth pin 464 of the -11 jack 466. A first pin 472, a sixth pin 474 and an eighth pin 476 of jack 462 are coupled to the, voltage sources VA, VB and VC, respectively, via a set of resettable fuses 478, 480, 482, respectively, that are sized to prevent an over-voltage condition. Further, a second pin 484 and a fourth pin 486 of the jack 462 are both coupled to a grounded terminal 488, and a fifth pin 490 is coupled to a voltage source, denoted Vdd, via a resistor 492. In addition, a first and a sixth pin 494, 496 of the jack 466 are not used, and a second pin 498 may be coupled to a grounded terminal 499. Thus, the product sensor logic circuit 228A may be used with a splitter box that is adapted to supply power to the monitored product and also with a splitter box that is not adapted to supply power to the monitored product provided that the proper jack 462 or 466 is disposed at the outputs of the product 228A.

For a splitter box 16A adapted to supply power to the sensor, the eight pins of the jack 462 are connected to a connector 447 also having eight pins (not shown) coupled to a set of eight conductors (not shown) for carrying the signals that are supplied to the jack 462. The eight conductors are disposed in the cable 18A which is configured as a single cable until reaching a desired length, at which point the cable 18A is split into two separate cables 18B and 18C. The cable 18B contains the conductors that carry the signals delivered to the first, sixth and seventh pins of the jack 462 to the sensor 10 and the cable 18C contains the conductors that carry the signals delivered to the second, third, fifth and eighth pins of the jack 466. In addition, an output plug 43 disposed at an end of the cable 18C provides an output pin (not shown) that carries a voltage level, i.e., one of either VA, VB or VC, that is suitable for the product being monitored with the security system 9. Further the adaptor plug 43 is configured so that it fits into a power supply input port (not shown) disposed on the product being monitored with the security system 9. As will be understood by one having ordinary skill in the art, the conductors disposed in the cable 1 8A and 1 8B for carrying power to the monitored product need not include three conductors that deliver all three voltages to the product but may instead include a single conductor for carrying a desired one of the voltage levels to the product.

It is to be understood that various modifications may be made to the invention without departing from the spirit and scope of the invention as defined in the appended claims. In particular various routine modifications to the circuitry and system logic will occur to those skilled in the art. For example, the shift registers 258, 282 could be replaced with flip-flops or any other device that functions as a storage register. In addition, the table for storing a high condition in the switch status shift register 258, indicating that a product sensor 10 is connected to the splitter box 16, may be incorporated in the splitter box 16 instead of the microcontroller 40. Further, the corresponding LED status shift register 282 may be set in accordance with this table by a logic circuit provided within the splitter box 16, and not by the microcontroller 40. Also, although the main controller unit 22, the splitter boxes 16 and the sensors 10 are shown as being physically connected with wires, the aforementioned components may instead be wirelessly coupled together. Further, the main controller unit 22 may also function as a single-sensor alarm system by monitoring the status of a single product sensor attached directly to the main controller unit 22 via an adapter cable. All such modifications and adaptations are intended to be covered by appended claims.

What is claimed is:

1. A security system adapted to monitor a product that requires power to be operational, comprising a control module, said control module being adapted to generate an alarm event based on an alarm signal;

at least one splitter box, said splitter box being communicatably coupled to said control module, wherein said splitter box is adapted to store at least one data bit, and further wherein said splitter box is further adapted to generate said alarm signal;

at least one sensor; and a sensor circuit coupled between said sensor and said splitter box, wherein said sensor is adapted to change from a first state to a second state, wherein at least one of said at least one splitter box is coupled to a power supply, and said security system further comprising a power adaptor coupled between said splitter box and the product, said power adaptor being adapted to supply power from said splitter box to the product.

2. A security system for monitoring a product that requires power to be operational, said security system comprising:

a control module;

one or more splitter boxes coupled to said control unit;

a power supply coupled to at least one of said splitter boxes; and a power adaptor coupled between said splitter box and the product for supplying power from said splitter box to the product.

3. The security system of claim 2 further comprising a sensor adapted to be attached to the product; and a sensor circuit coupled between said splitter box and said sensor.

4. The security system of claim 2 wherein said power supply is coupled directly to said at least one splitter box.

5. The security system of claim 2 wherein said control module is coupled to said power supply and is adapted to supply said power to said at least one splitter box.

6. The security system of claim 2 wherein said power supply is adapted to supply power at a single power voltage.

7. The security system of claim 2 wherein said power supply is adapted to supply power at a plurality of power voltages.

8. The security system of claim 7 wherein said power adaptor is further adapted to supply at least one of said plural power voltages to the product.

* * * * *